US007878961B2

(12) United States Patent
Carlucci et al.

(10) Patent No.: US 7,878,961 B2
(45) **Date of Patent: *Feb. 1, 2011**

(54) MUSCLE STRETCHING DEVICE AND METHOD OF USING THE SAME

(76) Inventors: John Carlucci, 2105 W. County Line Rd., Jackson, NJ (US) 08527; Rick Kocsis, 184 E. Veterans Hwy., Jackson, NJ (US) 08527; Mario Accumanno, 44 Cutter Dr., East Hanover, NJ (US) 07936; Paul J. McGrath, 15 Gary Ct., Flanders, NJ (US) 07836; Juan Fernandez, P.O. Box 312, Towaco, NJ (US) 07082

( * ) Notice: Subject to any disclaimer, the term of this patent is extended or adjusted under 35 U.S.C. 154(b) by 596 days.

This patent is subject to a terminal disclaimer.

(21) Appl. No.: 11/004,578

(22) Filed: Dec. 3, 2004

(65) Prior Publication Data

US 2005/0239619 A1 Oct. 27, 2005

Related U.S. Application Data

(63) Continuation-in-part of application No. 10/934,063, filed on Sep. 2, 2004, now Pat. No. 7,331,914, which is a continuation-in-part of application No. 10/730,313, filed on Dec. 4, 2003, now abandoned.

(51) Int. Cl.
*A63B 23/00* (2006.01)

(52) U.S. Cl. ..... 482/148; 482/140

(58) Field of Classification Search ..... 482/121–128, 482/142, 140

See application file for complete search history.

(56) References Cited

U.S. PATENT DOCUMENTS

| | | | | |
|---|---|---|---|---|
| 0,182,957 A | | 10/1876 | Quigley | |
| 1,746,111 A | | 2/1930 | Fisher | |
| 2,720,396 A | | 10/1955 | Pfaus | |
| 2,783,045 A | | 2/1957 | Bosch | 272/81 |
| 3,966,200 A | | 6/1976 | Kirk | 272/109 |
| 4,492,376 A | | 1/1985 | Schatz et al. | 482/130 |
| 4,632,393 A | | 12/1986 | Van Noord | |
| 4,867,143 A | | 9/1989 | Morin | 128/75 |
| 4,930,769 A | | 6/1990 | Nenoff | 272/120 |
| 5,094,445 A | | 3/1992 | Winkelvoss | 482/42 |
| 5,108,090 A | | 4/1992 | Reed | |
| 5,176,601 A | | 1/1993 | Reynolds | 482/130 |
| 5,263,913 A | * | 11/1993 | Boren | 482/96 |
| 5,295,935 A | * | 3/1994 | Wang | 482/130 |
| 5,383,831 A | * | 1/1995 | Drath | 482/101 |
| 5,478,299 A | | 12/1995 | Harmon | |

(Continued)

OTHER PUBLICATIONS

Office Action dated Apr. 17, 2007 in U.S. Appl. No. 10/934,063, filed Sep. 2, 2004, first named inventor John Carlucci.

(Continued)

*Primary Examiner*—Fenn C Mathew

(57) ABSTRACT

A device and method for stretching, toning and strengthening the chest, shoulder, neck and upper back muscles of a patient thereby relieving pain and improving posture. Typically the patient is suffering from tension related muscle problems. The device and method are used to facilitate therapeutic treatment of the muscle problems by progressively stretching the muscles and thereby relieving the muscle problems.

30 Claims, 21 Drawing Sheets

U.S. PATENT DOCUMENTS

| | | | | |
|---|---|---|---|---|
| 5,649,886 | A | 7/1997 | Danylieko | |
| 5,776,037 | A | 7/1998 | Millington | 482/91 |
| 5,833,590 | A * | 11/1998 | Chiu et al. | 482/142 |
| 5,957,955 | A | 9/1999 | Thomas | 606/243 |
| 6,030,325 | A | 2/2000 | Ottoson et al. | 482/144 |
| 6,071,217 | A * | 6/2000 | Barnett | 482/121 |
| 6,196,954 | B1 * | 3/2001 | Chen | 482/131 |
| 6,220,995 | B1 | 4/2001 | Chen | 482/140 |
| 6,220,996 | B1 | 4/2001 | McArthur | |
| 6,238,322 | B1 | 5/2001 | Hsu | |
| 6,245,000 | B1 | 6/2001 | Saakian et al. | 482/142 |
| 6,338,704 | B1 * | 1/2002 | Endelman | 482/142 |
| 6,416,447 | B1 | 7/2002 | Harmon | |
| 6,458,062 | B2 | 10/2002 | Conner | 482/129 |
| 6,468,192 | B1 | 10/2002 | Doerscheln | 482/142 |
| 6,569,069 | B1 | 5/2003 | Linares | 482/148 |
| 6,592,501 | B1 | 7/2003 | Mayes | 482/142 |
| 7,086,992 | B2 * | 8/2006 | Bowman et al. | 482/51 |
| 2004/0216929 | A1 * | 11/2004 | White | 180/2.2 |

OTHER PUBLICATIONS

Response to Office Action dated Apr. 17, 2007, filed on Jul. 16, 2007, in U.S. Appl. No. 10/934,063, filed Sep. 2, 2004, first named inventor John Carlucci.

Preliminary Amendment filed on Jul. 3, 2007, in U.S. Appl. No. 10/730,313, filed Dec. 4, 2003, first named inventor John Carlucci.

* cited by examiner

MUSCLE STRETCHING DEVICE AND METHOD OF USING THE SAME

RELATED APPLICATIONS

This application is a continuation-in-part of application Ser. No. 10/934,063, filed on Sep. 2, 2004 which is a continuation-in-part of application Ser. No. 10/730,313, filed on Dec. 4, 2003.

FIELD OF THE INVENTION

The present invention relates generally to exercise equipment and methods, and more particularly, to equipment and methods for stretching muscles.

BACKGROUND OF THE INVENTION

The present invention is directed to the field of therapeutic equipment used to stretch and exercise certain muscle groups. In particular the device and method of the present invention is directed to treatment of persons who are suffering from stress related muscle problems in the neck, shoulders and upper back.

Persons who suffer from these stress related problems typically appear to walk or stand in a slumped forward position which results in short and tight chest muscles. Further, their shoulder muscles are sagging and the upper back muscles between the shoulder blades are long, atrophied and very sore. When the head is carried forward, the muscles in the upper back and lower neck are significantly strained just keeping the head erect. This medical condition is known as "anterior translation" and is the single largest cause of upper back and neck pain as well as tension headaches in the skull. Typically, these conditions result in spinal misalignment of the neck and upper back. The spinal misalignment problems usually start early in life and progress to more serious conditions such as disc problems and hump back.

In the past, one of the therapies for the aforementioned problems has been various exercises intended to stretch the muscles without the use of any device to facilitate the exercise. However, patients performing such exercises have generally been unable to precisely and consistently repeat the particular motions associated with the exercises, resulting in a diminished therapeutic effect. The device and method of the present invention is adapted to facilitate and improve upon the muscle stretching exercises which relieves the problems mentioned above.

SUMMARY OF THE PREFERRED EMBODIMENTS

The present invention is directed to a platform comprising a device for stretching the muscles in the chest, shoulder, neck and upper back to relieve tension related muscles problems. The device comprises a generally flat longitudinally extending area comprising a top surface and a bottom surface wherein preferably the top surface is padded for a user's comfort, a plurality of legs attached to the bottom surface of the platform for positioning the device at an angle to a horizontal surface and a rotating handle bar slidingly attached to the bottom of the platform and adapted to allow the user to stretch his or her muscles through sliding movement of the bar in a direction generally parallel to the top of the platform.

The present invention is also directed to providing a method for stretching chest, shoulder, neck and upper back muscles of a patient to relieve tension related muscle problems. The method comprises providing a device comprising a platform comprising a generally flat longitudinally extending area comprising a top surface and a bottom surface wherein the top surface is padded for the patient's comfort, a plurality of legs attached to the bottom surface of the platform for positioning the device at an angle to a horizontal surface and a rotating handle bar slidingly attached to the bottom of the platform and adapted to allow the patient to stretch his or her muscles through sliding movement of the bar in a direction generally parallel to the top of the platform, positioning the patient on the platform of the device, engaging the patient in stretching exercises by setting the rotating handle bar to a position relative to the top of the platform and directing the patient to slidingly move the rotating handle bar a plurality of times to stretch out muscles.

In accordance with another aspect of the present invention, a muscle stretching device comprising a platform assembly, a base assembly and a handlebar assembly connected to the platform assembly is provided. The platform assembly preferably comprises a first section, a second section and a concave transition between the first and second sections. In preferred embodiments, the platform assembly has a compact position and an expanded position.

In accordance with yet another aspect of the present invention, a muscle stretching device is provided which comprises a base assembly mounted to a platform and a handlebar assembly. The handlebar assembly is preferably adapted for sliding movement with respect to the platform in a direction parallel to a plane defined by a surface of the platform. In preferred embodiments, the handlebar assembly comprises a handlebar that is adapted to rotate with respect to the plane. In additional preferred embodiments, the handlebar is adapted to rotate to a plurality of pre-selected positions with respect to the plane, more preferably, three preselected positions. In other preferred embodiments, the handlebar is adapted to rotate above and below the platform plane.

In accordance with still another aspect of the present invention, a muscle stretching device comprising a platform assembly, a handlebar assembly, and a guide assembly is provided. The platform assembly comprises a platform mounted to a base assembly. The guide assembly is attached to the platform and includes a frame having a pair of sidewalls. At least one roller assembly is attached to each sidewall. The handlebar assembly comprises a sliding engagement member connected to a handlebar, and the sliding engagement member slidingly engages the guide assembly. In a preferred embodiment, the guide assembly is attached to the lower surface of the platform. In other preferred embodiments, the sliding engagement member slidingly engages the guide assembly between the roller assembly and the lower surface of the platform. In still other preferred embodiments, three roller assemblies are provided.

In accordance with further aspects of the present invention, a method of stretching the muscles for use by a person is provided. According to the method, a platform assembly comprising a platform mounted to a base assembly is provided. The platform has surface that defines a plane. A handlebar assembly is provided which comprises a handlebar adapted for sliding movement with respect to the platform in a direction parallel to the platform plane. To perform the method, the person lies on the platform, grips the handlebar, and extends the handlebar away from the platform in a direction parallel to the plane.

In a preferred embodiment, the person rotates the handlebar to a pre-selected position with respect to the plane before extending it. In accordance with other preferred embodiments, the position is about 10 degrees below the plane. In further preferred embodiments, the position is about 40 degrees above the plane, in still other preferred embodiments, the position is about 90 degrees above the plane. In still other preferred embodiments, the platform comprises a first section, a second section, and a concave transition between the first and second sections and the person extends the handlebar such that her shoulders extend beneath the top surface of the platform. In yet additional preferred embodiments, the handlebar defines a plurality of fixed handlebar locations, and the user grips the handlebar at one of those fixed locations. It is particularly preferred that the person repeat the extension step while gripping three different fixed locations.

In accordance with still another aspect of the present invention, a muscle stretching device is provided which comprises a platform assembly, a guide assembly, and a handlebar assembly. The platform assembly comprises a platform mounted to a base, wherein the platform defines a plane. The guide assembly is connected to the platform and includes at least one pair of rollers. Each roller has a roller axis projecting away from the plane of the platform and is rotatable bout its respective roller axis. The handlebar assembly is connected to the platform and includes a handlebar and a sliding engagement member connected to the handlebar, wherein the sliding engagement member slidingly engages the guide assembly.

In a preferred embodiment, the guide assembly has a frame, the frame is connected to the platform and the pair of rollers is connected to the frame. In another preferred embodiment, the sliding engagement member slidingly engages the guide assembly between the pair of rollers. In yet another preferred embodiment, the handlebar is rotatable with respect to the plane of the platform.

In another aspect of the present invention, a muscle stretching device is provided which comprises a platform mounted to a base. The platform has a surface defining a plane. The device further comprises a handlebar having a neck, a cross-bar, and a plurality of rotational positions with respect to the plane of the platform. A handlebar mounting assembly is operatively connected to the platform and adapted for sliding movement away from the platform in a direction parallel to the plane. The handlebar mounting assembly comprises a pair of sidewalls and a handlebar mounting sleeve connected to the pair of sidewalls. The handlebar mounting sleeve is rotatable between the pair of sidewalls, and the handlebar neck is disposed in the handlebar mounting sleeve. In a preferred embodiment, each sidewall has a plurality of apertures, the plurality of apertures in one sidewall is aligned with the plurality of apertures in the other sidewall to define a plurality of aligned pairs of apertures, and each aligned pair of apertures defines one of the plurality of handlebar rotational positions. In other preferred embodiments, the handlebar mounting sleeve is rotatable with respect to the plane.

In still other preferred embodiments, the handle bar mounting assembly comprises a rotational alignment sleeve connected to the handlebar mounting sleeve, wherein the rotational alignment sleeve is alignable with each of the plurality of aligned pairs of apertures. In further preferred embodiments, the handlebar cross-bar is adjustable to a plurality of distances from the handlebar mounting sleeve.

In yet another aspect of the present invention, a muscle stretching device is provided which includes a platform and a base. The base comprises a unitary first base member having two legs integrally connected by a first cross-member. The first base member is pivotally connected to the platform assembly such that the platform assembly is adjustable between a compact position and an expanded position. The device further comprises a handlebar operatively connected to the platform assembly proximate the platform assembly. In a preferred embodiment, the base further comprises a second base member connected to the platform assembly, the platform has a length defining a lengthwise direction, and the first base member is spaced apart from the second base member in the lengthwise direction.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
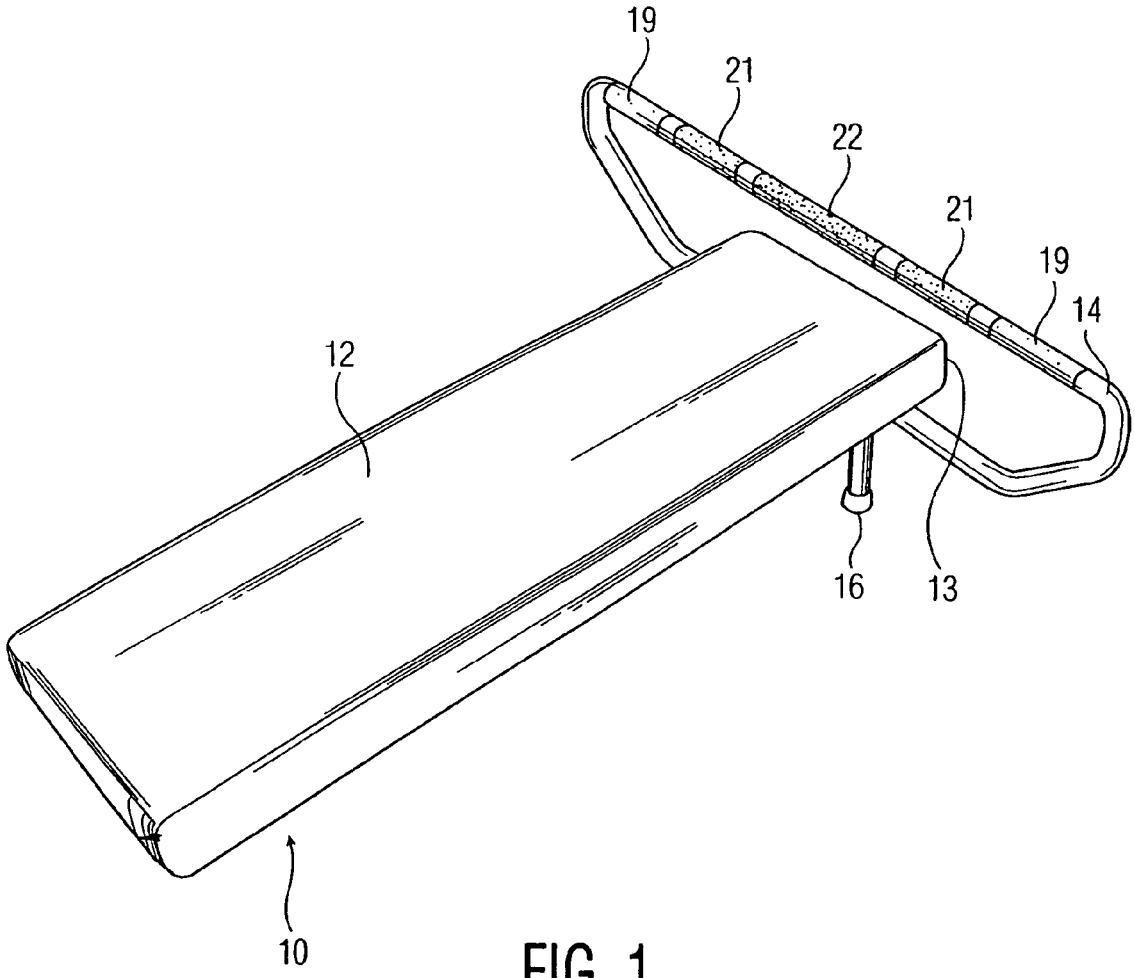
FIG. 1 is a perspective view of a first embodiment of the present invention.
Figure 2:
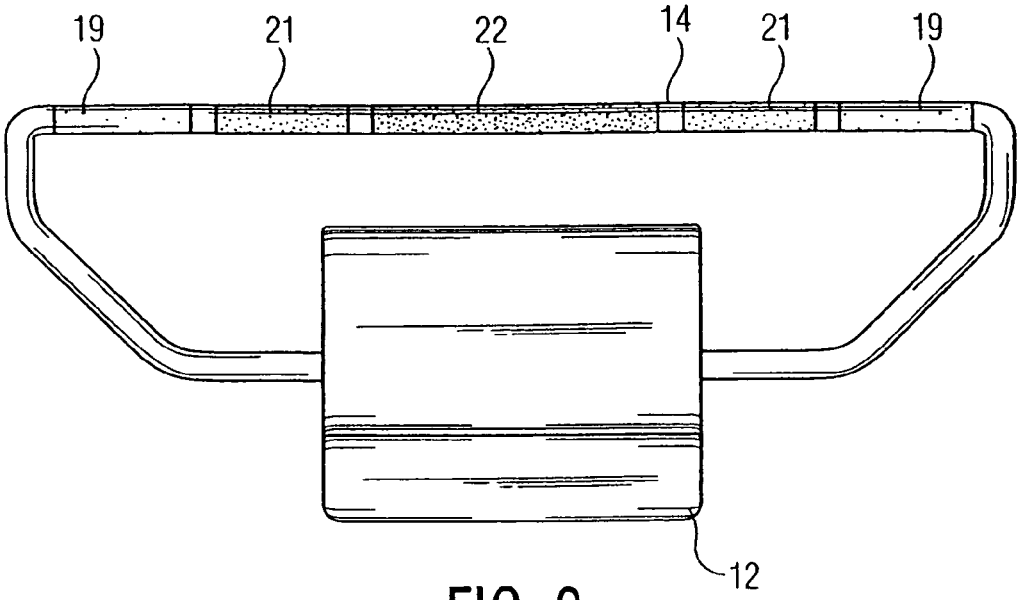
FIG. 2 is a rear elevational view thereof.

The present invention will now be described in the context of its presently preferred embodiment as illustrated in the drawings. Those of ordinary skill in the art will recognize that many obvious modifications may be made thereto with departing from the spirit or scope of the invention as set forth in the appended claims.

Referring to FIGS. 1-9, in accordance with a first preferred embodiment of the present invention, exercise device 10 comprises a platform 12 on which a user of the device will lay. The platform 12 is padded and covered with a vinyl material for the comfort of the users. A rotating handle bar 14 is slidingly connected to the bottom of the platform 12 at its top end 13. The device 10 further comprises a plurality of legs 16. The legs 16 are fixed to the bottom of platform 12 in a conventional manner near its top end 13. The legs 16 are sized to provide the proper angle to the horizontal for the stretching exercises described below.

Figure 3:
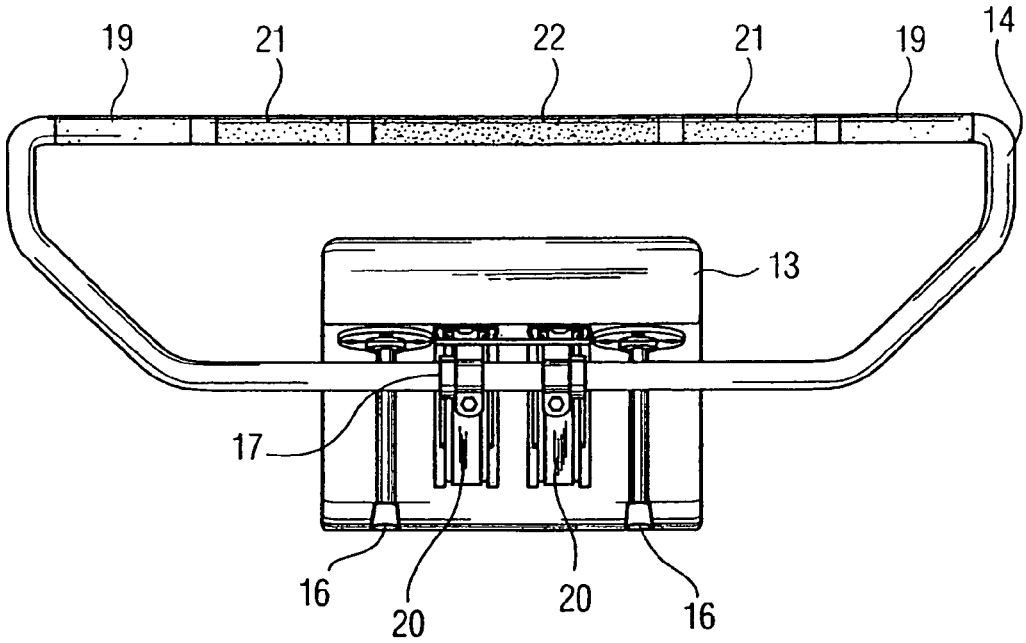
FIG. 3 is a front elevational view thereof.
Figure 4:
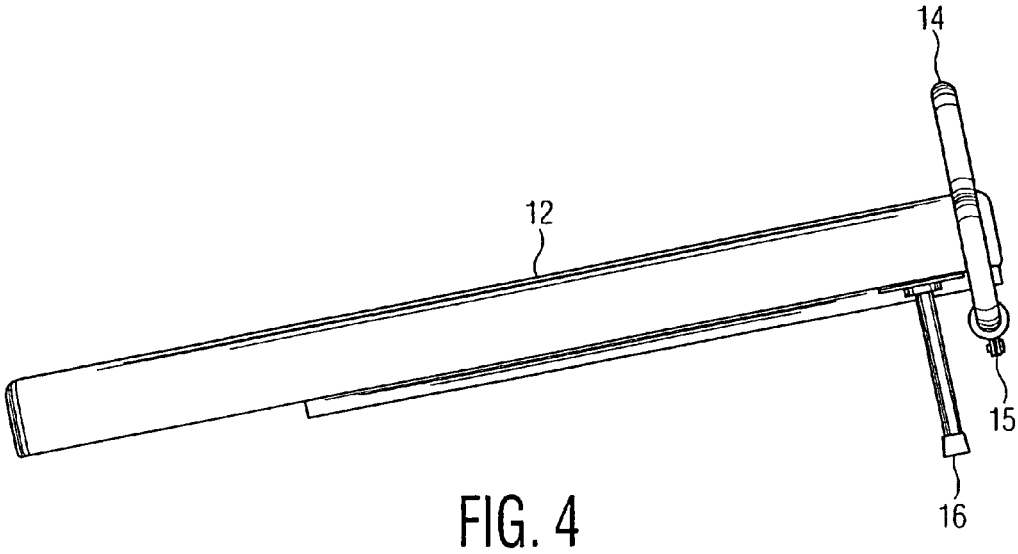
FIG. 4 is a right-side elevational view thereof.
Figure 5:
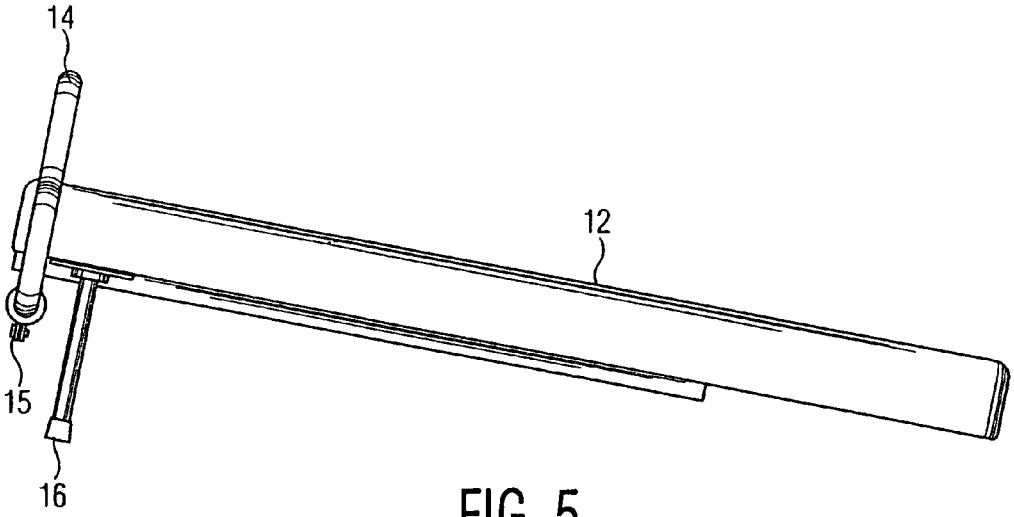
FIG. 5 is a left-side elevational view thereof.
Figure 6:
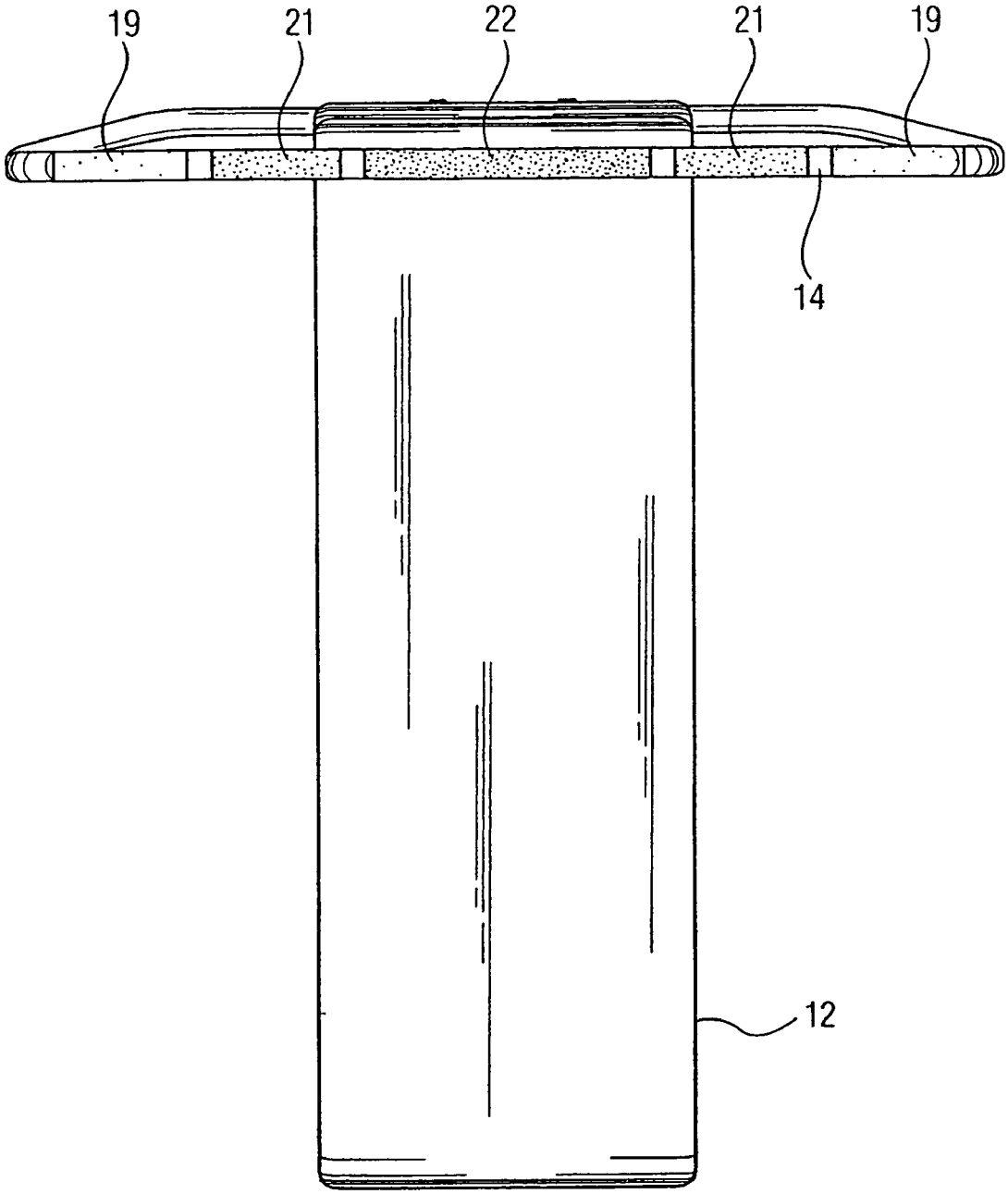
FIG. 6 is a top plan view thereof.
Figure 7:
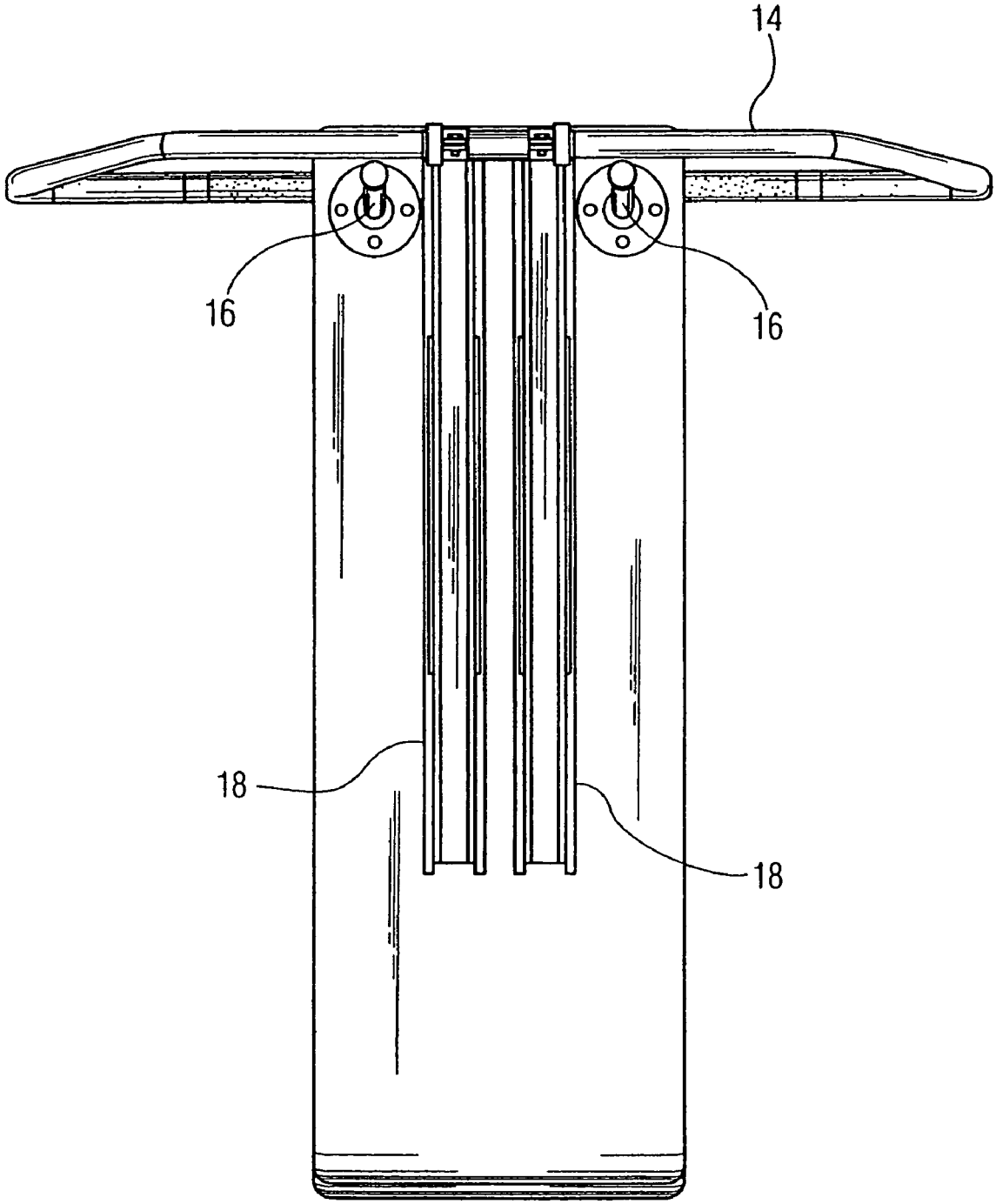
FIG. 7 is a bottom plan view thereof.

As illustrated in FIG. 7, the bottom of platform 12 is provided with a first set of elongated tracks 18. As shown in FIG. 3, the rotating handle bar 14 is connected to a second set of elongated metal tracks 20. The tracks 20 are adapted to be slidingly received in tracks 18. As described below, when the user moves the bar 14, the tracks 20 will be extended in a longitudinal direction into and out of tracks 18.

A ring pin 15 on the rotating handle bar 14 allows the user to rotate the handle bar 14 to different positions with respect to the top of the platform 12. As explained below, changing the angle of the rotating handle bar 14 with respect to the platform 12 allows the user to set the difficulty level for the stretching exercises.

The method of using the device 10 will now be described. First, the user sets the rotating handle bar 14 to the position with respect to platform 12 that provides the easiest movement. This is accomplished by removing the ring pin 15, turning the bar 14 to a first mark 17, and reinserting the ring pin 15.

Figure 8:
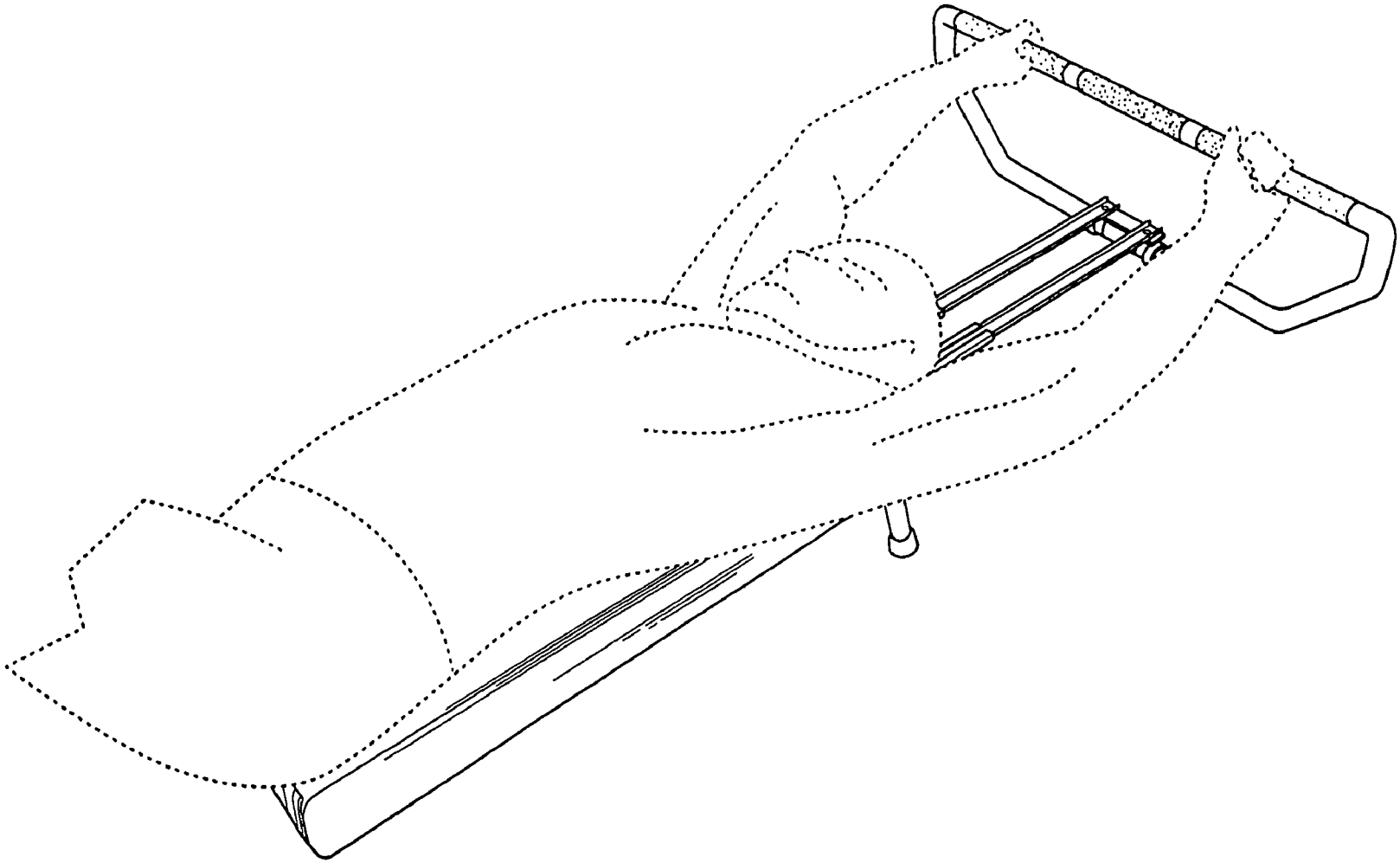
FIG. 8 is a perspective view thereof.

As partially illustrated in FIG. 8, the user lies on the platform 12 on her back with her head at the top end 13 of the platform 12. She flexes her knees to the chest and positions the feet directly under her buttocks. The user then does three stretches each of which is progressively more strenuous. The stretches target the muscle groups from the outer edge of the body to progressively closer to the midline of the spine. For the easiest stretch, the user places her or his hands on outer stripes 19 on rotating handle bar 14. She extends the arms above the head and then repeats the exercise and thereby extends rotating handle bar 14 by means of the tracks 20 extending out of the tracks 18. The user then locks the elbows, slowly counts to about 60 or more, and then retracts the bar 14 into the original position.

This position—with the hands on the outer stripes 19—stretches and tones the muscles of the chest as well as the muscles along the outer sides of the body which including the chest, trunk and arms. Next, she places her hands on middle stripes 21 and repeats the same exercise. This stretches and tones the muscle groups between the outer edge of the body and midline of the spine including the muscle around the shoulder blades and shoulder joints. Finally, the user places both hands on inner stripe 22. This stretches the key muscle groups along the spine itself including those in the mid and upper back, the lower neck, and across the traps.

The user is able to completely stretch and tone all of the joints and muscle groups across the chest, in the shoulders and rotator cuff, the traps and upper shoulders, the lower neck, the upper and mid back, as well as the key groups between the shoulder blades in a relatively short period of time. Thus, the key muscle groups that cause stress, back pain, neck pain, and tension headaches are stretched out. Consequently, the user's stress related symptoms will be lessened and/or preferably alleviated through repetition of these exercises.

Once the user is comfortable using the device 10 of the present invention in the easiest setting, she or he can set the handle bar 14 through the adjustment of the ring pin 15 to a setting which causes more stretching by rotating bar 14 further from the top of platform 12. The increased setting puts more external rotation into the shoulder girdle which dramatically increases the stretch benefit when extending overhead. After the user is comfortable with an increase, she or he can progress to a more advanced setting by rotating the bar 14 further from the top of platform 12. This is the most challenging and therapeutic of all.

Figure 9:
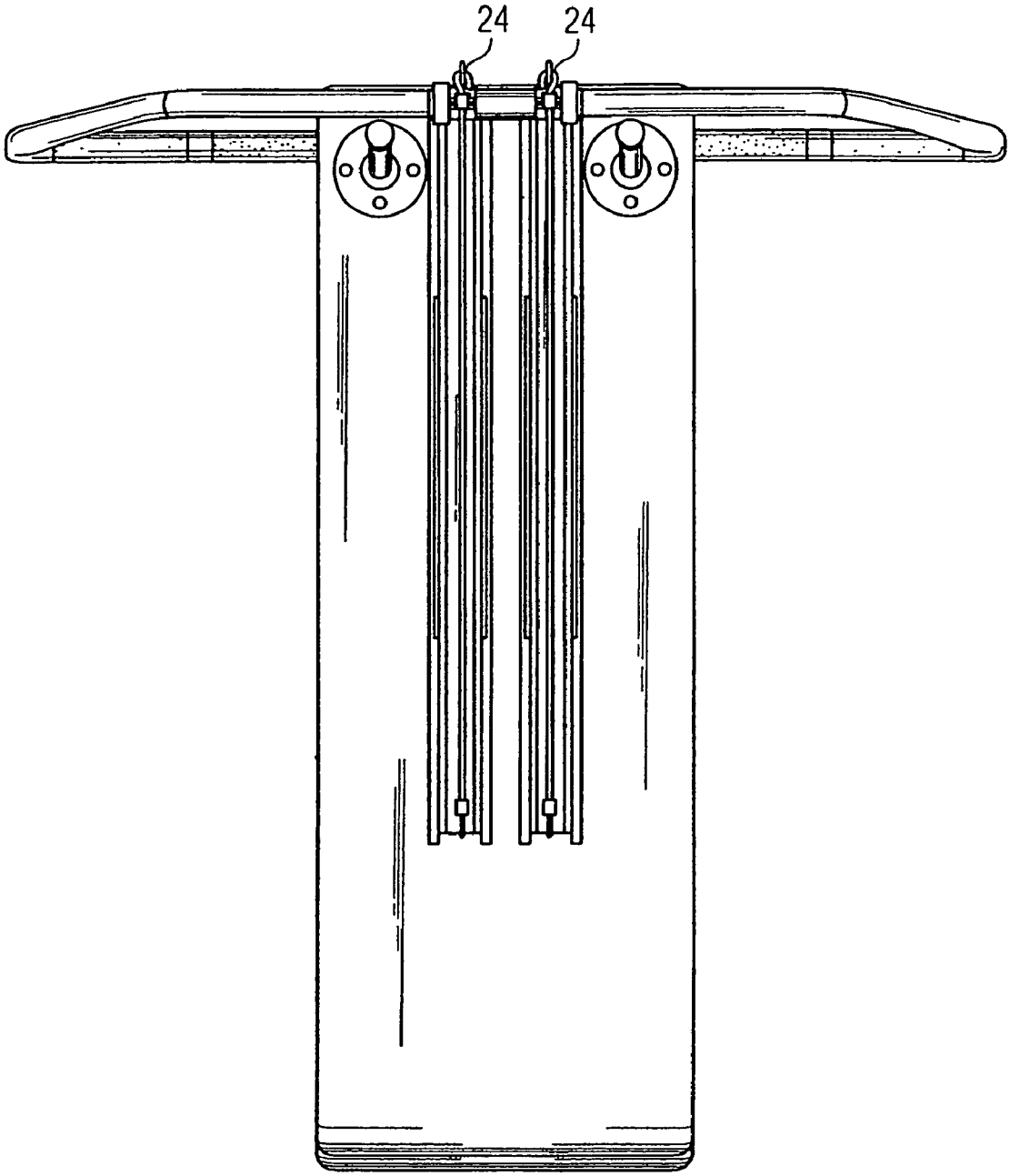
FIG. 9 is a bottom view thereof.

When the user has reached the point of maximum stretch and flexibility, which will be different for everyone, she or he can gain more benefit by adding resistance to the regimen described above. Resistance adds the benefits of increased muscle tone, stamina, and strength. As illustrated in FIG. 9, resistance is added by attaching a stretchable band 24 between the rotating bar 14 and the bottom of the platform 12. After the resistance is added, the same exercises as described above are repeated. More bands or stronger bands may be added to further increase resistance. The resistance bands take the user to a new level by giving strength and endurance, as well as flexibility.

Figure 10:
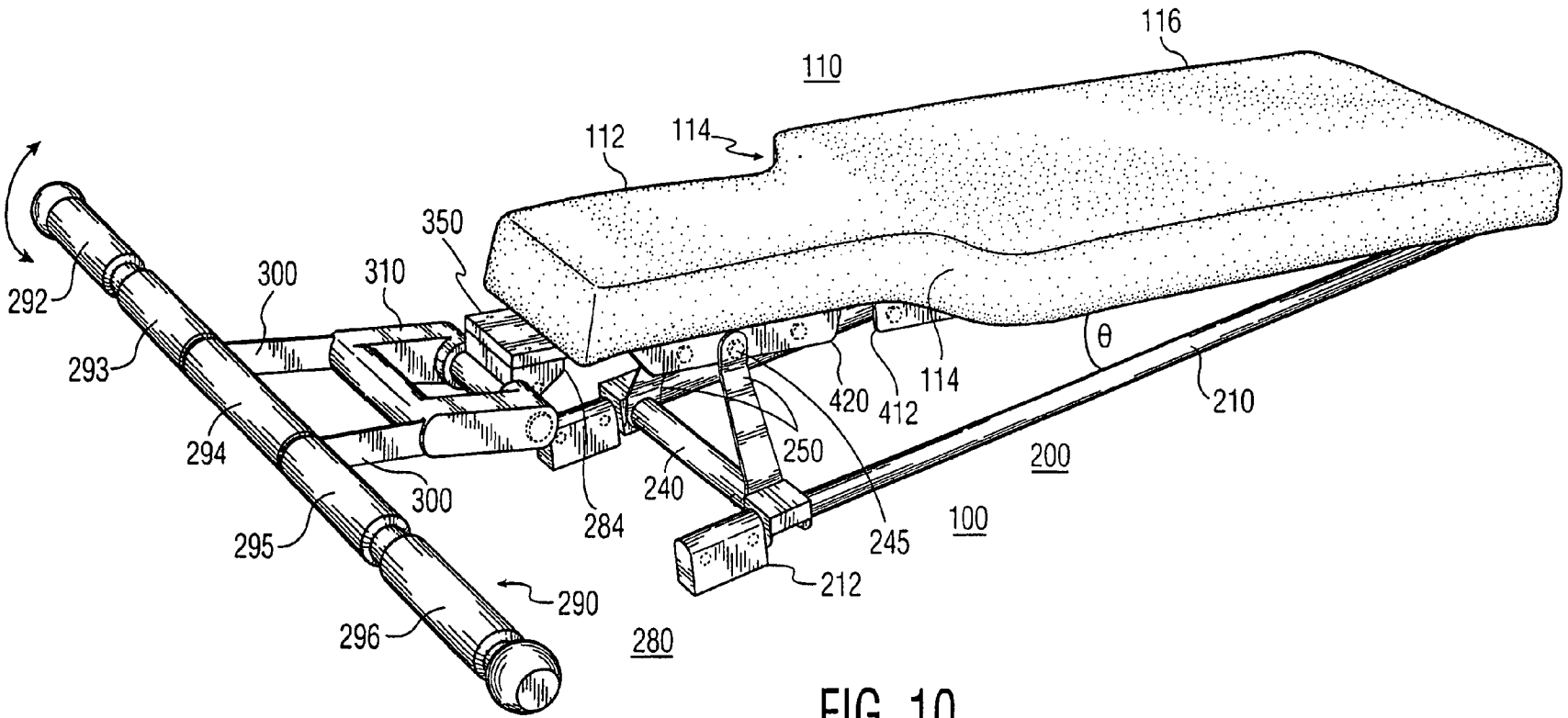
FIG. 10 is a perspective view of a second embodiment of the present invention.

A muscle stretching device in accordance with a second preferred embodiment is depicted generally in FIG. 10. As shown in the Figure, the device of this embodiment comprises a platform assembly 100 comprising a platform 110, a base assembly 200, and a handlebar assembly 280.

Figure 10A:
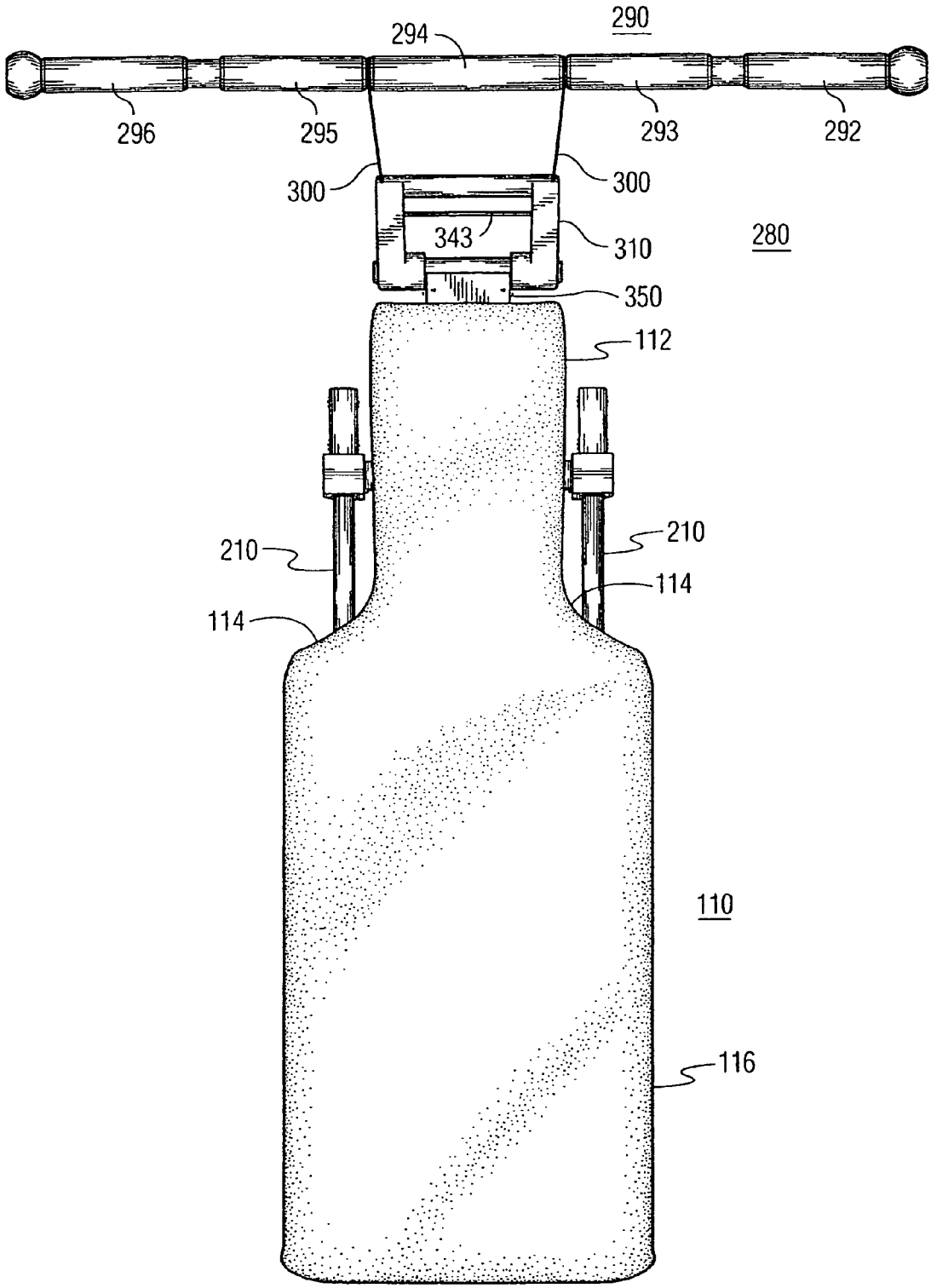
FIG. 10*a* is a top plan view thereof.

Platform 110 preferably includes a padded material and a vinyl covering for user comfort. Platform 110 includes a first section 112 where the user places his head and a second section 116, where the user places his torso and legs. Concave transition 114 connects first section 112 and second section 116. Concave transition 114 is best seen in FIG. 10A, which is a top plan view of the exercise device of the second embodiment. As FIG. 10A indicates, first section 112 comprises straight side portions of platform 110 as does second section 116. As shown in FIG. 10A, first section 112 is generally wider than second section 116. Concave transition 114 comprises two concave side portions of platform 110, each of which connect the first section 112 and second section 116 on each side of platform 110. In use, the user places his shoulders at concave transition 114, such that they roll back and dip below the top surface of platform 110 when extending handlebar 290 away from platform 110. The ability to roll back and dip the shoulders in this manner provides a more therapeutically effective stretch. However, concave transition 114 can have a number of different specific curvatures that provide this functionality.

Figure 11:
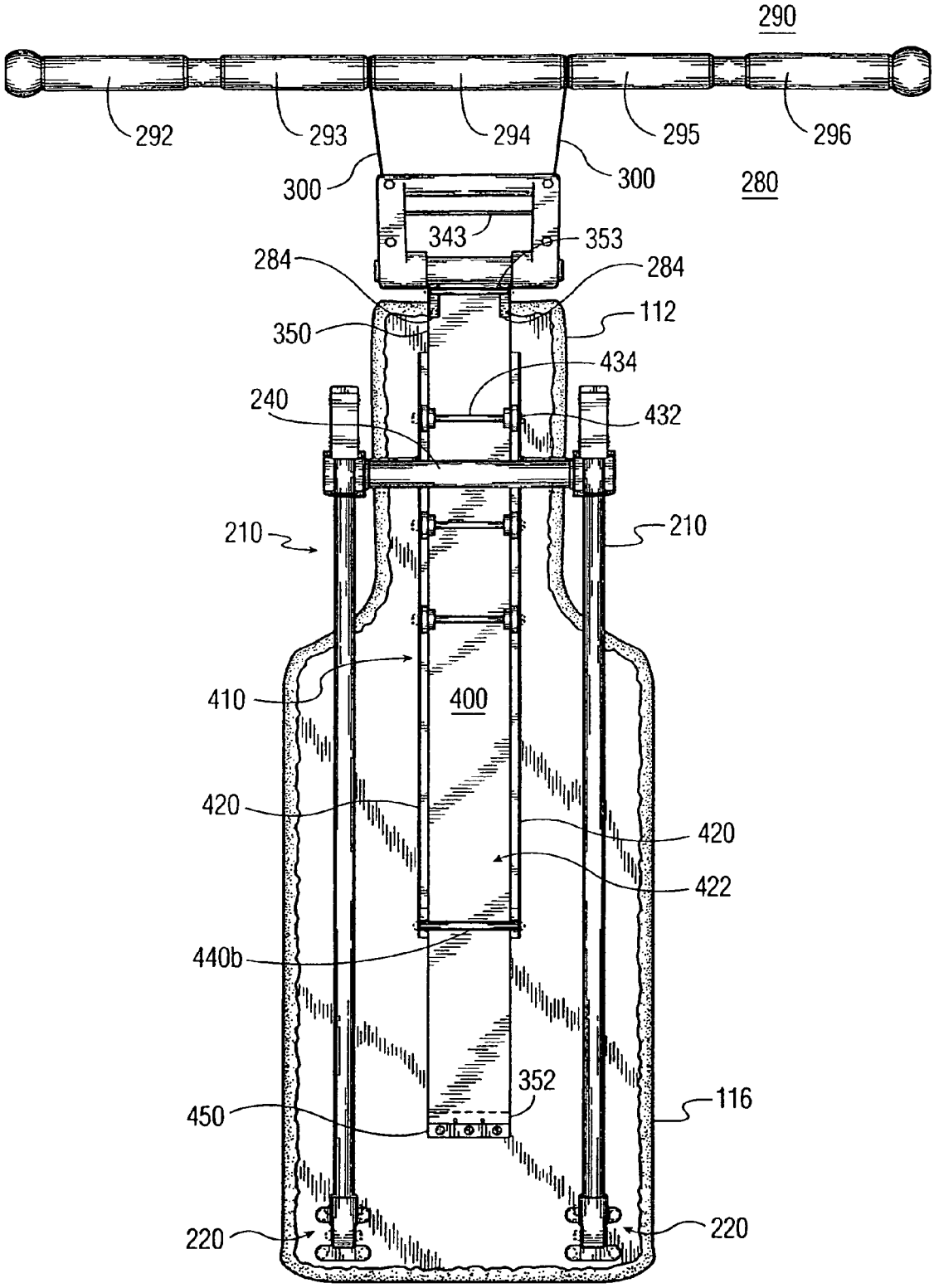
FIG. 11 is a bottom plan view thereof.

Base assembly 200 is collapsible and comprises two legs 210, which are attached at an end of platform 110 near second section 116 and away from handlebar assembly 280. Legs 210 are connected by cross-member 240. As best seen in FIG. 11, legs 210 are pivotally connected to the lower surface of platform 110 by a bracket assembly 220. The pivotal connection allows legs 210 to open and close, enabling the user to collapse the device for ease of storage.

Handlebar assembly 280 comprises a handlebar 290 attached to a pair of handle brackets 300. Handle brackets 300 are connected to a handlebar housing 310 which is adapted to rotate to a plurality of preselected positions, as will be described in greater detail below. Handlebar assembly 280 also includes a sliding engagement member 350, preferably a rectangular metal glide, which allows the user to slide handlebar 290 away from platform 110 in a direction parallel to the surface of platform 110. Sliding engagement member 350 has upper and lower surfaces. The upper surface (not shown) is preferably smooth. However, the lower surface can be smooth, as in FIG. 11, or corrugated, as in FIG. 12.

As best seen in FIG. 11, the device of the second embodiment includes a guide assembly 400 which cooperates with sliding engagement member 350 to enable handlebar 290 to slidably move with respect to platform 110. Guide assembly 400 comprises a frame 410 having a pair of sidewalls 420. In the embodiment of FIG. 11, the sidewalls 420 are connected by an integral flat portion 422 that is secured to the lower surface of platform 110 by suitable fasteners. A plurality of roller assemblies 430 are connected to each side wall. Each roller assembly comprises two rollers 432 connected by a roller shaft 434. Rollers 432 are spaced apart from integral flat portion 422 and rotate freely within frame 410.

Sliding engagement member 350 is disposed within frame 410 such that its lower surface rests on rollers 432 beneath the integral flat portion 422 and the lower surface of platform 110. The engagement of sliding engagement member 350 with rollers 432 enables the handlebar assembly 280 to slide in and out of frame 410, and thereby slideably move with respect to platform 110. Thus, handlebar 290 can be extended from platform 110 in a controlled manner, as it is restrained by the sliding engagement member 350 and roller assemblies 430 such that it can only move in a direction that is parallel to platform 110.

Figure 13:
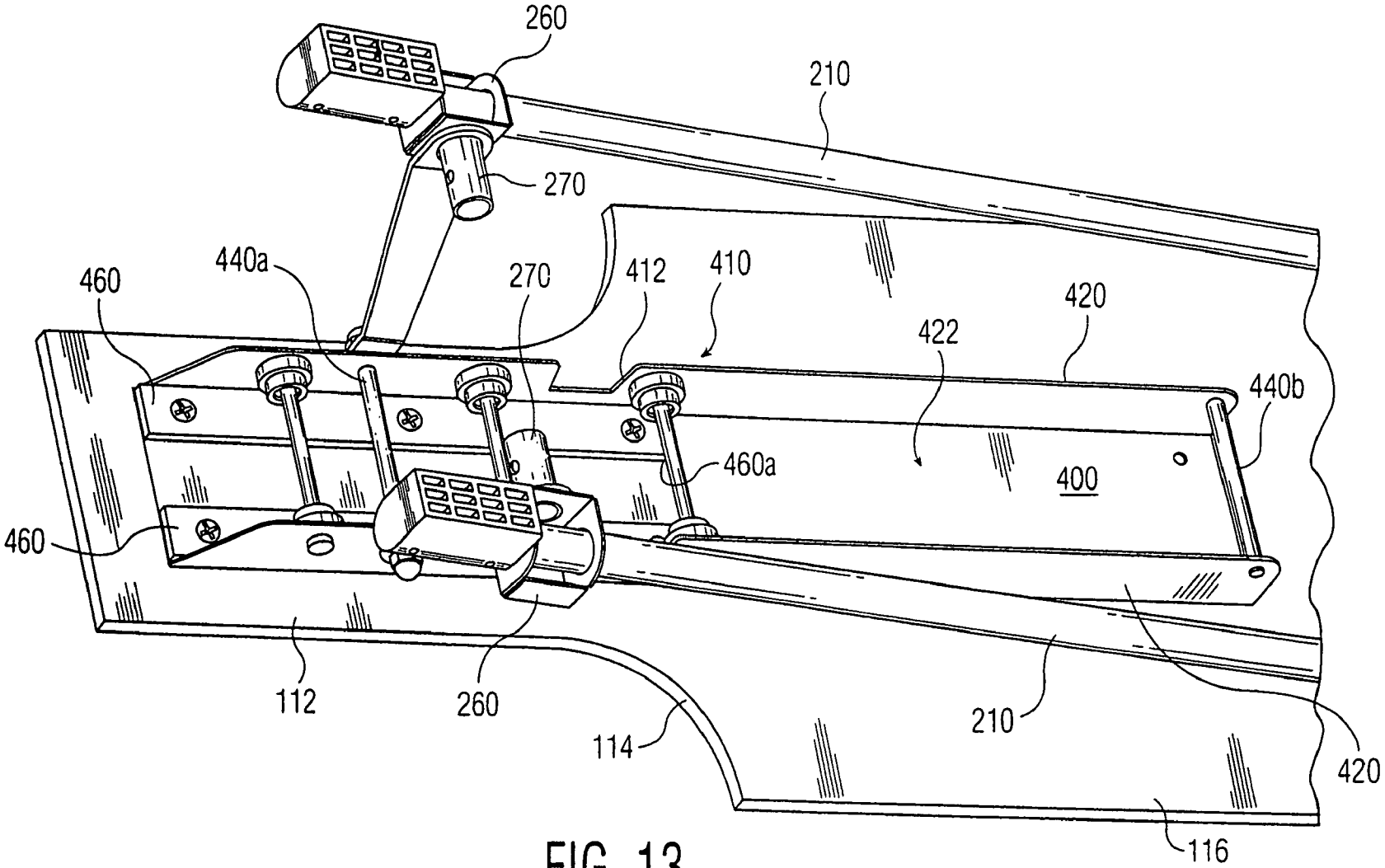
FIG. 13 is a detail view of the second embodiment of the present invention.

FIG. 13 depicts the device of the second embodiment with the handlebar assembly 280 and cross-member 240 removed. As shown in the figure, the device of the second embodiment further comprises a handlebar extension restraint 460 for restraining the movement of handlebar assembly 280 as the user slides it away from platform 110. Handlebar extension restraint 460 prevents the user from sliding handlebar assembly 280 entirely out of guide assembly 400. Preferably, handlebar extension restraint 460 comprises two rectangular blocks secured to integral flat portion 422 and the lower surface of platform 110 by suitable fasteners such as t-nuts. Handlebar restraint 460 has two faces 460*a* (one of which is shown) which are used to abuttingly restrain the movement of sliding engagement member 350. A variety of materials can be used for the handlebar restraint, however, an acetyl copolymer such as DELRIN®, a registered trademark of DuPont Corporation, is especially preferred.

Figure 14:
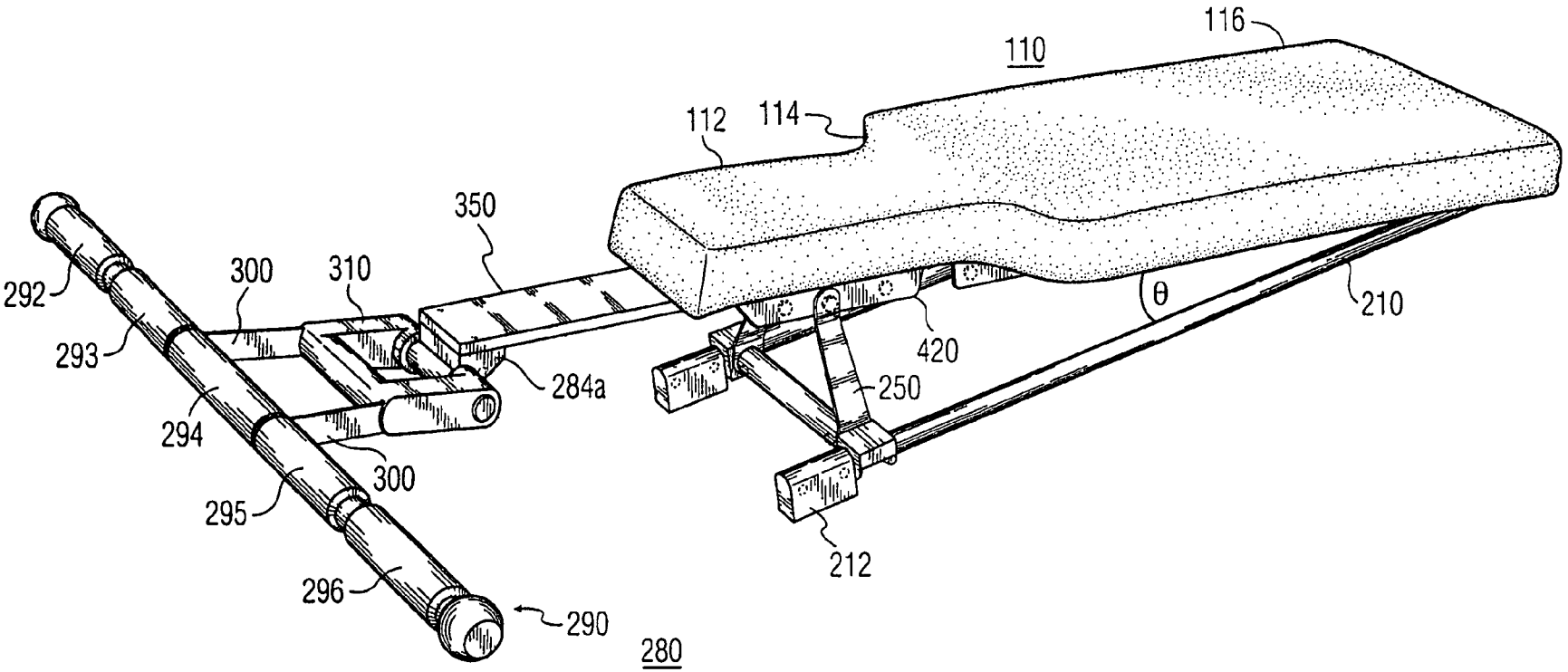
FIG. 14 is a view of the second embodiment of the present invention with the handlebar assembly fully extended.

To prevent it from being pulled out of guide assembly 400, sliding engagement member 350 includes an extension restraining piece 352 on its free end away from handlebar assembly 280. Preferably, restraining piece 352 is a rectangular block of DELRIN®, secured at the end of sliding engagement member 350 and facing towards the lower surface of platform 110. Restraining piece 352 and handlebar extension restraint 460 are preferably of sufficient thickness that when the user slides handlebar assembly 280 away from platform 110, restraining piece 352 will eventually abut handlebar restraint 460 at face 460*a*, thereby preventing further movement of handlebar assembly 280 away from platform 110. At this point, handlebar assembly 280 is fully extended from platform 110, as depicted in FIG. 14. In like fashion, handlebar retraction restraint 450 is attached to lower surface of platform 110 away from handlebar assembly 280. Retraction restraint is preferably a rectangular block of DELRIN®. Restraining piece 352 and retraction restraint 450 are preferably of sufficient thickness that when the user retracts handlebar assembly 280, restraining piece 352 abuts against retraction restraint 450, thereby preventing further retraction. At this point, handlebar assembly 280 is in its fully retracted position.

According to the second embodiment, the exercise device is collapsible. To provide collapsibility, base assembly 200 includes a pair of arms 250, each of which is pivotally connected at one end to frame 410 of guide assembly 400 located on the lower surface of the platform 110. Any known connector which provides a pivotal connection between arms 250 and frame 410 can be used, such as bolts 245. Arms 250 are also connected to bearing carrier 260 via nipples 270, as shown in FIGS. 10 and 13. Arms 250 include an aperture designed to accommodate nipples 270 attached to bearing carriers 260. Arms 250 are thereby able to rotate about nipples 270. Each leg 210 of base assembly 200 is inserted through a corresponding bearing carrier 260, such that each bearing carrier 260 can slide along its corresponding leg 210. Each nipple 270 is secured within a corresponding end of cross-member 240 by a known connector, such as a nut and bolt or a clevis pin and retainer. The free end of each leg 210 is also provided with a foot 212 which restrains the movement of bearing carrier 260.

As a result of the foregoing configuration, when the user pushes cross-member 240 away from handlebar assembly 280, bearing carriers 260 slide along their respective legs 210 in the same direction. As a result, arms 250 rotate away from handlebar assembly 280 and eventually abut the lower surface of platform. Frame 410 includes notch 412 which is sized to accommodate cross-member 240. Once arms 250 have fully rotated away from handlebar assembly 280, cross-member 240 is positioned within notch 412, at which point the device is in its compact position and ready for storage.

When in use, platform 110 is preferably angled with respect to the legs 210 and the surface on which the device is placed such that the first section 112 is elevated above second section 116. A variety of angles (θ) between platform 110 and legs 210 can be used. An angle of 0 to 20 degrees is preferred. An angle of 5 to 15 degrees is especially preferred and an angle of 10 degrees is most preferred. The angle is also preferably adjustable between angles of 0 to 20 degrees, and more preferably between 0 and 15 degrees, with an adjustable angle of 0 to 10 degrees being especially preferred.

As mentioned previously, the device of the second embodiment is designed to enable the user to rotate handlebar 290 to several pre-selected positions with respect to the plane defined by the lower surface of platform 110. An exploded view of a preferred embodiment of the handlebar assembly is provided in FIG. 12. Handlebar 290 comprises three pieces, a center piece 294*a* and right and left pieces 293*a* and 295*a* (not shown in FIG. 12) which are coupled to center piece 294*a*, preferably by screwing or snapping thereto. Handle brackets 300 are attached at one end to handle bar center piece 294*a* and at an opposite end to an inner tube 330 by fastener 331.

It is especially preferred that center piece 294*a* have internally threaded ends which are configured for threaded engagement with complementary external threads on right and left pieces 293*a* and 295*a*. Center piece 294*a* also includes a pair of hubs 298 on each of its ends. Bracket apertures 301 are positioned on hubs 298 such that brackets 300 are fixed between right piece 293*a* and center piece 294*a* and between left piece 295*a* and center piece 294*a* when the right and left pieces are coupled to center piece 294*a*. Center piece 294*a* is inserted into foam grip 294, and right and left pieces 293*a* and 295*a* are inserted into foam grip pairs 292 and 293 and 295 and 296 and 296, respectively.

Figure 12:
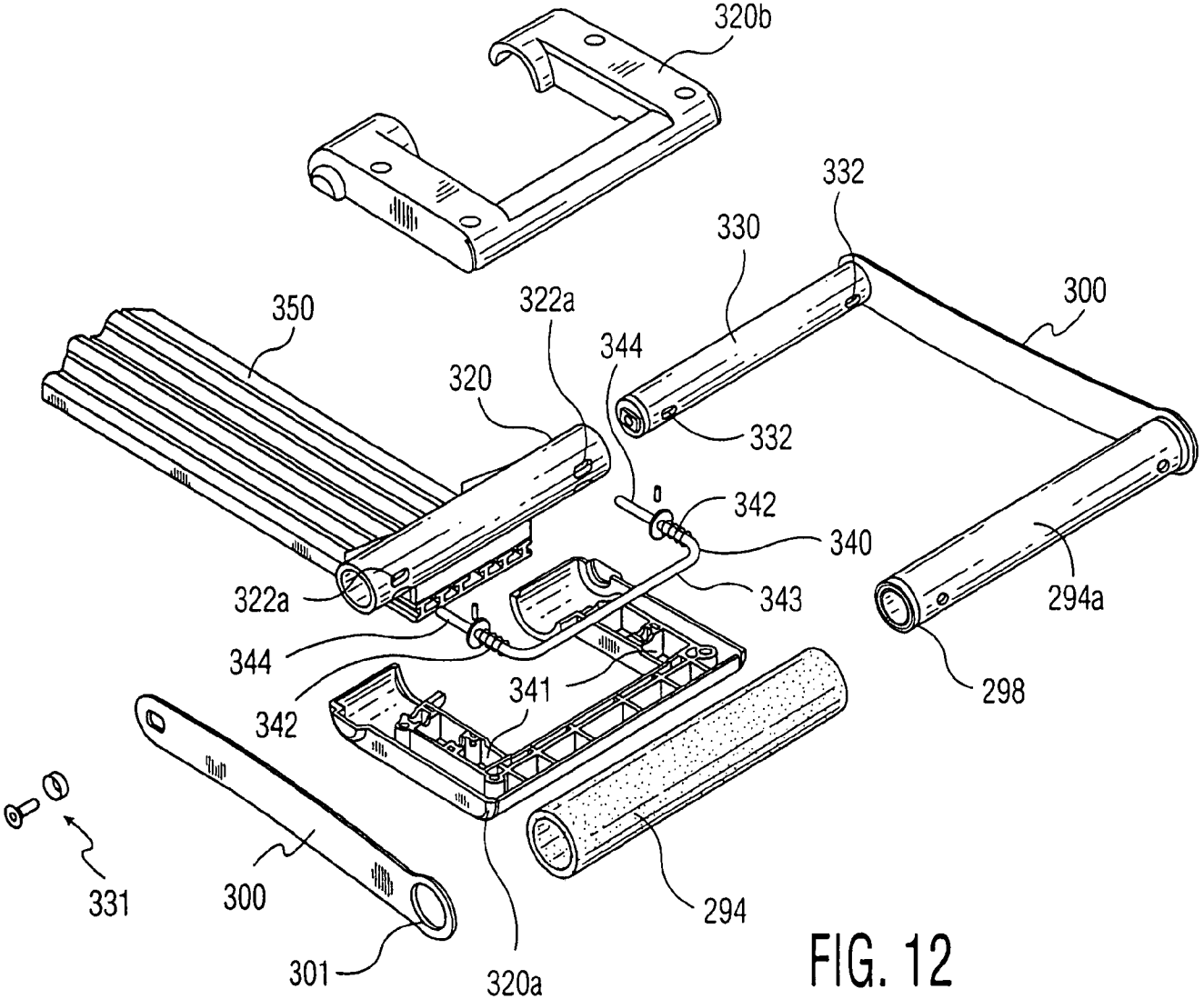
FIG. 12 is an exploded view of a portion of a handlebar assembly used in accordance with the present invention.

A hollow outer tube 320 is fixedly attached to an outer tube bracket 284 connected to the bottom surface of sliding engagement member 350. The outer tube 320 has three aperture pairs 322*a-c* (only one pair of which is shown in FIG. 12). The apertures comprising each pair are axially spaced apart from one another proximate opposite ends of outer tube 320. Each aperture pair 322*a-c* is spaced apart from the other pairs around the circumference of outer tube 320. The positions of the three aperture pairs 322*a-c* define the pre-selected rotational positions of the handlebar 290.

Again referring to FIG. 12, inner tube 320 is disposed in the hollow outer tube 320. Inner tube 320 contains a single pair of apertures 332 which are alignable with each of the aperture pairs 322*a-c* of outer tube 320. Inner tube 320 has a longitudinal axis which is the axis of rotation of handlebar 290.

Handlebar housing 320 comprises upper half 320*b* and lower half 320*a*, which are secured to one another, preferably by screws, so as to partially contain handle brackets 300, and the apertured portions of outer tube 320. A locking member 340, preferably a spring lock, is provided for releasable insertion through apertures 332 and aperture pairs 322*a-c*. Locking member 340 has a locking position and a release position. In the locking position, locking member 340 is inserted through apertures 332 and one of aperture pairs 322*a-c*. In the release position, it is withdrawn from apertures 332 and aperture pairs 322*a-c*. In the embodiment depicted in FIG. 12, locking member 340 has a c-shape with a pair of ends 344 connected by a center portion 343. Springs 342 are provided to bias locking member 340 in a locking position towards outer tube 320. Upper half 320*b* and lower half 320*a* of handlebar housing 320 each include complementary pairs of molded in spring retainer guides 341 for retaining locking member 340 and springs 340 within housing 320.

FIGS. 10, 10*a* and 11 show the handlebar assembly in its assembled state. Aperture pairs 322*a-c* define three rotational positions located at about 10 degrees below, 40 degrees above and 90 degrees above the plane defined by the lower surface of platform 110. To adjust the position of handlebar 290, the user grips center portion 343 of locking member 340 thereby pulling ends 344 out of inner tube aperture pair 332 and one of outer tube aperture pairs 322*a-c*. While gripping locking member 340, the user rotates handlebar 290, handle brackets 300, locking member 340, housing 310 and inner tube 330 about the longitudinal axis of inner tube 330. Because it is fixedly attached to the bottom of sliding engagement member 350, outer tube 320 remains stationary during this rotation. Once the user reaches the desired rotation corresponding to one pair of aperture pairs 322*a, b* or *c*, he releases locking member 340. The biasing action of springs 342 then inserts ends 344 through one of the aperture pairs 322*a, b* or *c* of outer tube 320 and through aperture pair 332 of inner tube 330, thereby locking the handlebar 290 into place at the desired rotational position.

The muscle stretching device of this embodiment is preferably designed to facilitate stretching with the hands positioned at multiple widths from one another on handlebar 290. Stretching at wider hand spacings focuses on the most lateral muscles, including the triceps, latissimus, and lateral rotator cuff muscles. Stretching at narrower hand spacings focuses on the spinal and para-spinal muscles of the lower cervical spine and the entire thoracic spine. Intermediate spacings focus on muscles lying between the foregoing positions along the posterior of the body, including the trapezius and the scapular muscles, as well as muscles located along the anterior of the body such as the pectoralis and the anterior chest muscles.

The muscle stretching device of this embodiment is more preferably designed to facilitate stretching with the hands placed at three widths from one another. Referring again to FIG. 10, handlebar 290 is provided with a plurality of foam segments 292-296. The foam segments allow the user to repeatably space his hands at fixed distances from the center of handlebar 290 when using the device, thereby providing for more consistent stretching and enhanced therapeutic effect. For example, the user can use foam segments 292 and 296 to position the hands for a wide stretch, foam segments 293 and 295 for an intermediate stretch, and foam segment 294 for a narrow stretch. The widths and positions of the foam segments 292-296 are preferably designed to focus the user's stretching on the three sets of muscle groups identified above for wider, narrower and intermediate hand spacings.

A preferred embodiment of a method for stretching muscles using the device of the second embodiment will now be described. According to this embodiment, the user first adjusts handlebar 290 to the desired rotational position as described above. If more strenuous stretching is desired, handlebar 290 is rotated below the plane defined by the lower surface of platform 110. Referring to FIG. 1, this corresponds to a counterclockwise rotation of handlebar 290. If less strenuous exercise is desired, handlebar 290 is rotated above the plane. The user then lies on platform 110 with her head positioned in first section 112 and her feet located at the opposite end in second section 116. The user's shoulders should be positioned at concave transition section 114 such that they can roll back and dip below the plane of the top surface of platform 110 when extending handlebar 290. As with the embodiment of the method described previously, the user flexes her knees to her chest and positions her feet directly below her buttocks to take the forward lumbar curve out of the lower back.

The user then grips the foam segments 292-296 to obtain the desired spacing of the hands with respect to the center of handlebar 290. For easier stretching, the outermost foam segments 292 and 296 are gripped. For the most difficult stretching, center foam segment 294 is gripped with both hands. It is especially preferred that the user perform three sets of progressively more strenuous stretches, starting from the outside of handlebar 290 and working inward. The particular muscles that are targeted by using the various positions defined by foam segments 292-296 on handlebar 290 are described above.

While gripping handlebar 290, the user extends her arms away from platform 110 until fully extended and preferably holds them in the fully extended position for at least 60 seconds. She then retracts her arms to the starting position. It is especially preferred to hold the stretch for at least 60 seconds at each of the three hand spacings defined by foam segments 292296.

The user can optionally add additional resistance to the stretching device of the second embodiment by attaching a resistance increasing device such as a stretchable band, an elongated spring or a bungee cord to it. As shown in FIGS. 11 and 13, two-cross bars 440*a* (not visible in FIG. 11) and 440*b* are preferably provided and attached to sidewalls 420 of frame 410. The user can attach the ends of such a resistance increasing device to one of the cross-bars 440*a* and 440*b* and to mounting bar 353 which is secured to the bottom of glide 350 proximate handlebar housing 310. In addition, the user can wrap a resistance increasing device around cross-bar 440*a* or 440*b* and attach both ends of the resistance increasing device to mounting bar 353. It is especially preferred to connect a linear resistance spring to mounting bar 353 and cross-bar 440*b*. If further increased resistance is desired, it is particularly preferred to wrap a linear resistance spring around cross-bar 440*a* and connect both ends of the spring to mounting bar 353.

The device and method described above stretches the chest muscles, tightens the mid back muscles, lifts the chest and pulls the shoulders up and back. The result is preferably improved posture. By straightening the posture, the head is balanced over the shoulders, as it should be and thereby taking all the aggravating stress of the neck and upper back muscles away from the person.

Referring to FIGS. 15-22, a third preferred embodiment of a muscle stretching device in accordance with a preferred embodiment of the present invention will now be described.

As with the previous embodiment, the device of this embodiment includes a platform 110 having a first section 112 and second section 116 connected by a concave transition 114. However, the guide assembly, handlebar assembly and base have been modified.

Figure 15:
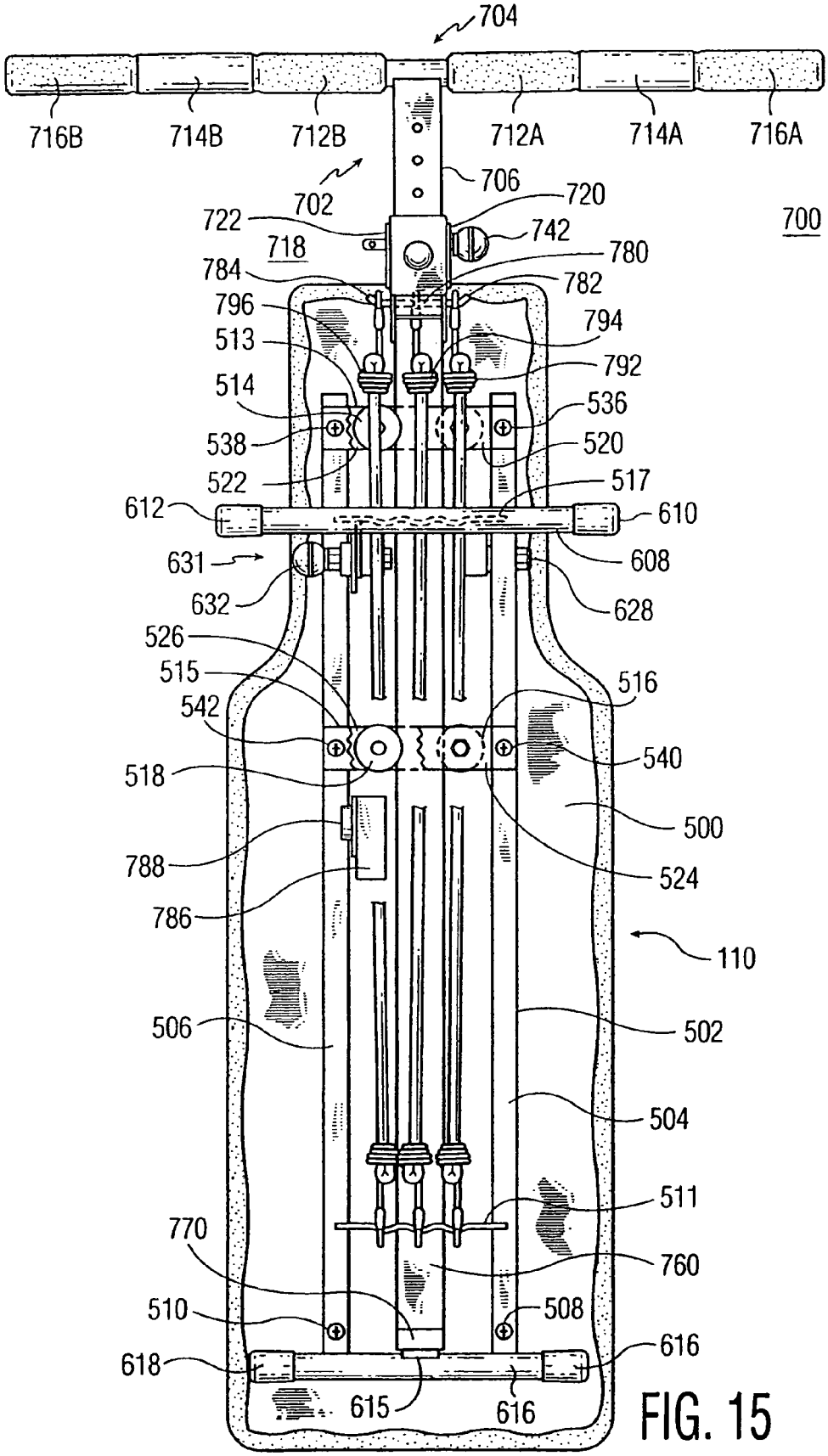
FIG. 15 is a bottom plan view of a third embodiment of the present invention.

FIG. 15 is a bottom plan view of a muscle stretching device in accordance with the third preferred embodiment. As shown in the figure, the muscle stretching device includes a handlebar assembly 700 with handlebar 702 and a sliding engagement member, which is preferably a glide 760. Along with guide assembly 500, glide 760 operatively connects the handlebar 702 to platform 110. Handlebar 702 is mounted in a handlebar mounting assembly 718 that is connected to glide 760, as will be described in greater detail below.

The device of the third preferred embodiment preferably includes a guide assembly 500 having a frame 502 with two side members 504 and 506. Side members 504 and 506 are preferably connected to the underside of platform 110 at various locations. In the embodiment of FIG. 15, screws 508 and 506 are provided near the foot of the platform (i.e., away from the handlebar assembly 700) for securing side members 504 and 506 to platform 110. As will be explained below, roller assemblies 513 and 515 preferably include fasteners 536, 538, 540 and 542 which also secure side members 504 and 506 to platform 110.

Figure 16:
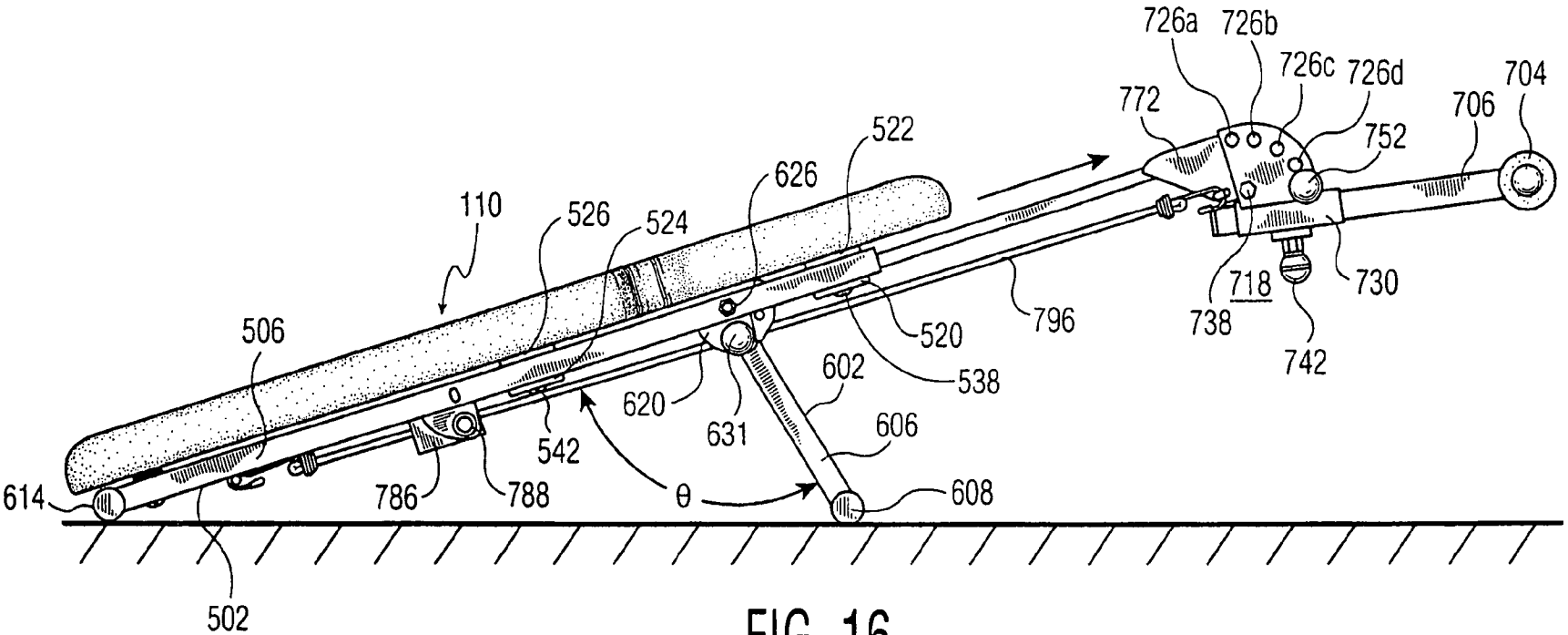
FIG. 16 is a right side elevational view thereof in which the handlebar is extended.

As best seen in FIG. 16, handlebar glide 760 slidingly engages guide assembly 500 to allow the user to slide handlebar 702 away from and towards platform 110 in a direction parallel to the plane defined by the surface of platform 110. To facilitate this sliding engagement, guide assembly 500 includes at least one roller assembly. In the embodiment of FIG. 15, two roller assemblies 513 and 515 are provided and are spaced apart along the length of platform 110. Roller assembly 513 includes two rollers 512 and 514 spaced apart from one another along the width of platform 110. Rollers 512 and 514 each have roller shafts 528 and 530 (see FIGS. 17 and 22) which are preferably bolts around which rollers 512 and 514 respectively rotate. Similarly, roller assembly 515 includes rollers 516 and 518 and their respective roller shafts 532 and 534.

Roller assembly 513 includes roller mounting members 520 and 522. Roller mounting members 520 and 522 are preferably flat rectangular plates, between which rollers 512 and 514 are disposed. To better illustrate the orientation of the rollers and roller mounting members, in FIG. 15 the left hand portion of roller mounting members 520 and 522 has been removed. Roller mounting member 522 is located proximal to platform 110 (see FIGS. 19 and 21) and roller mounting member 520 is spaced apart from roller mounting member 522 in a direction that is away from platform 110, and which is more preferably substantially perpendicular to platform 110.

It is preferred that roller shafts 528 and 530 are connected to each of the roller mounting members 520 and 522 to secure rollers 512 and 514 between the roller mounting members 520 and 522. Unlike the previous embodiment, roller shafts 528 and 530 are oriented such that they project away from the plane defined by the surface of platform 110. More preferably, roller shafts 528 and 520 are substantially perpendicular to the bottom surface of platform 110, such that the top and bottom surfaces (facing out of the page and into the page, respectively) of rollers 512 and 514 are substantially parallel to platform 110.

At opposite ends of roller mounting members 520 and 522, holes are provided for accepting fasteners. The holes in the opposing ends of the roller mounting members are preferably aligned with one another and with a corresponding hole in the respective side member, 504 or 506. A screw 536 is preferably inserted through one end of roller mounting member 520, the opposed end of roller mounting member 522 and side member 504. Screw 536 also preferably extends into the underside of platform 110. Similarly, screw 538 is preferably inserted through the other pair of opposing ends of roller mounting members 520 and 522 and through side member 506. Screw 538 also preferably extends into the underside of platform 110. Thus, screws 536 and 538 secure frame 502 to the platform and secure roller mounting members 520 and 522 to frame 502.

Roller mounting assembly 515 is preferably configured similarly to roller mounting assembly 513. Rollers 516 and 518 are disposed between roller mounting members 524 and 526, with member 526 being located proximal to platform 110 and member 524 being spaced apart from member 526 in a direction away from platform 110.

Roller shafts 532 and 534 are each connected to roller mounting members 524 and 526 to secure rollers 516 and 518 between roller mounting members 524 and 526. At opposite ends of roller mounting members 524 and 526, holes are provided for accepting fasteners, which are preferably screws 540 and 542. As with roller assembly 513, it is preferred that screws 540 and 542 are secured to the ends of respective side members 504 and 506 and to the underside of platform 110.

Figure 17:
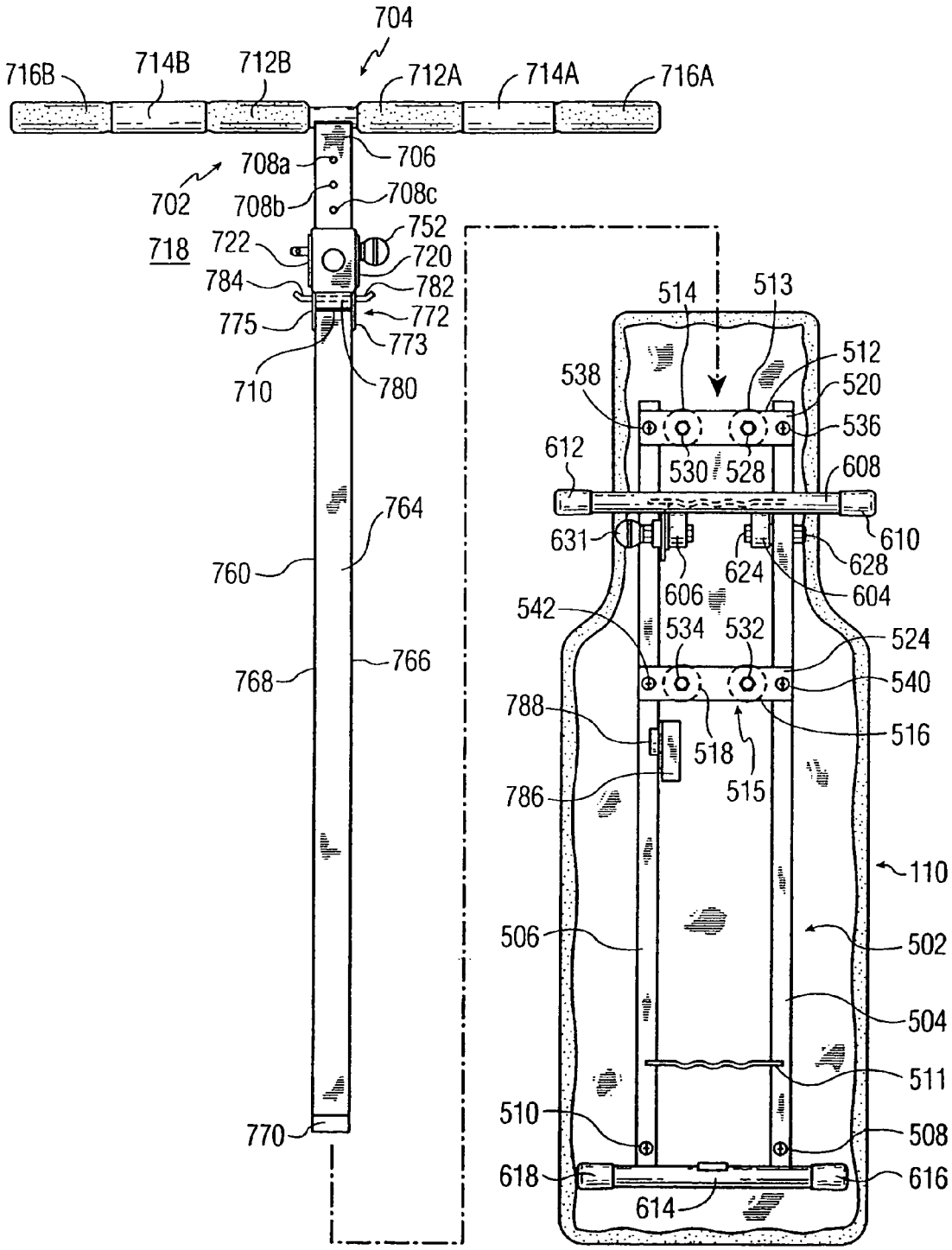
FIG. 17 is an exploded view thereof with the handlebar assembly removed from the platform assembly.

To facilitate the sliding engagement of handlebar assembly 700 with platform assembly 100, a sliding engagement member, preferably a glide 760, is provided. FIG. 17 provides an exploded view of the stretching device of the third embodiment with the handlebar assembly 700 removed from the platform assembly 100. Glide 760 is preferably an elongated member having a top 762 facing platform 110 (facing into the page), a bottom 764 facing away from platform 110 and first and second sides 766 and 768 (FIG. 17). First side 766 engages roller 512 in roller assembly 513 and roller 516 in roller assembly 515. Correspondingly, second side 768 engages roller 514 in roller assembly 513 and roller 518 in roller assembly 515.

Figure 19:
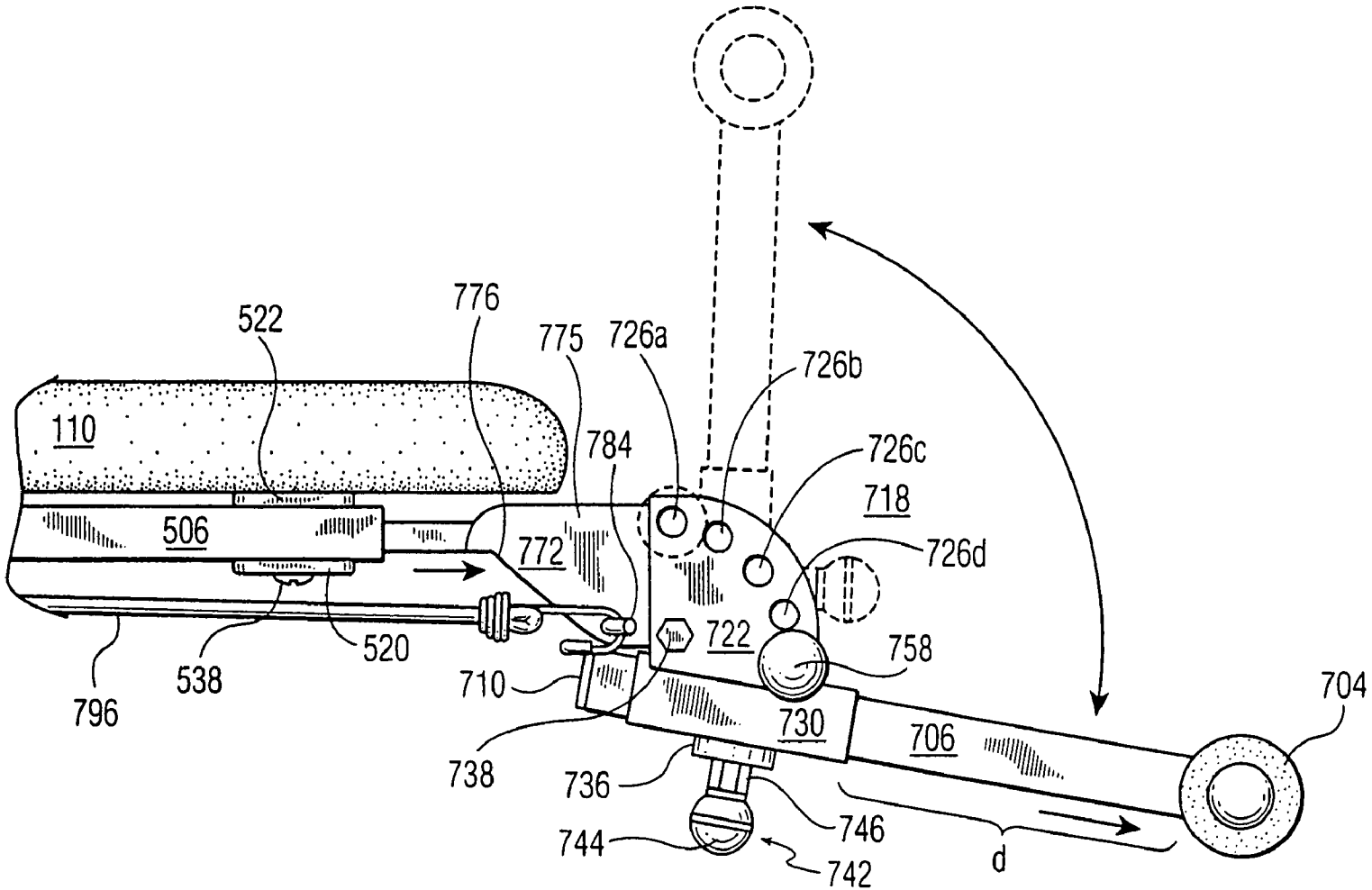
FIG. 19 is a portion of a right side elevational view thereof showing the handlebar in different rotational positions.
Figure 20:
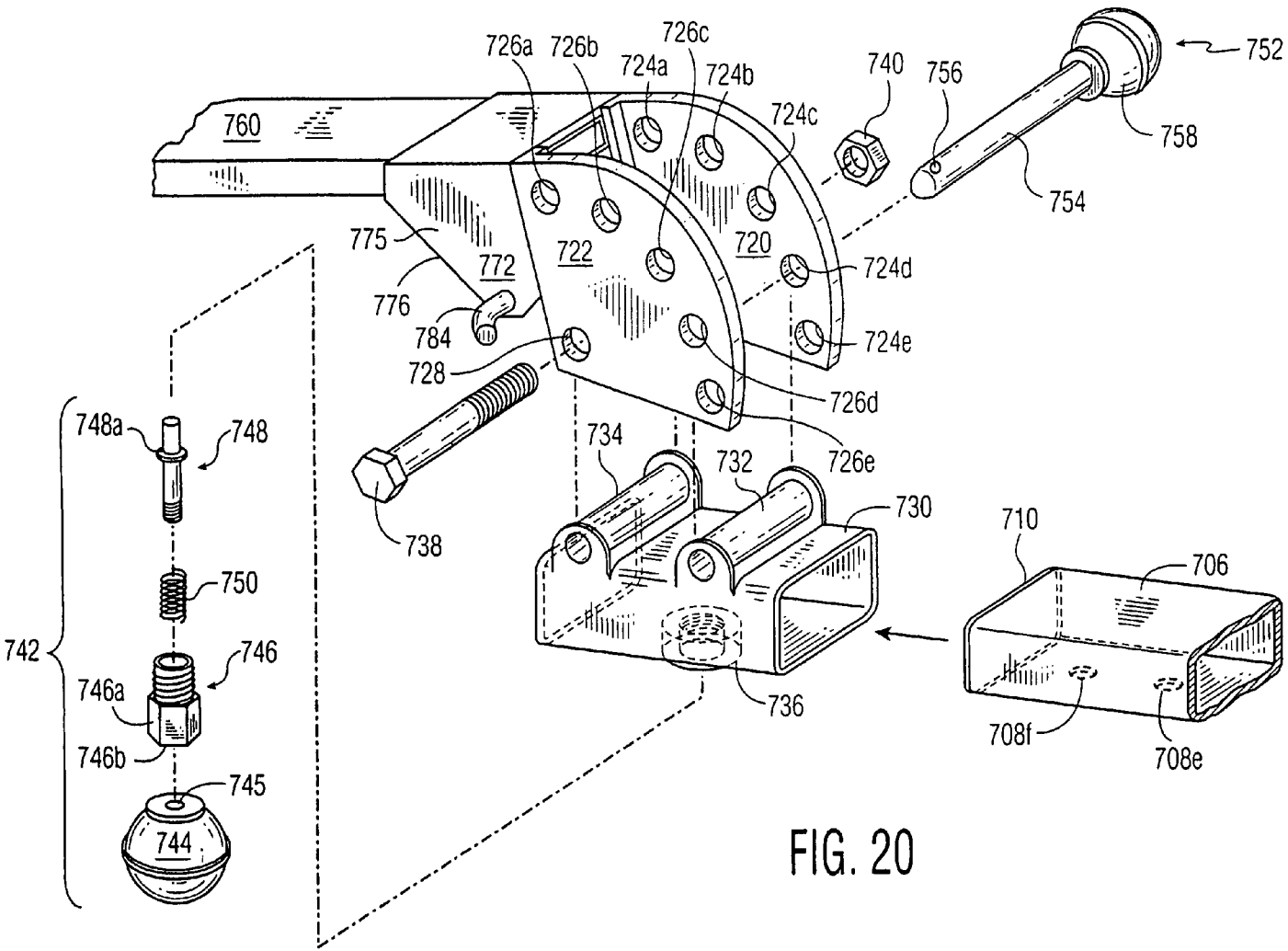
FIG. 20 is an exploded view of a handlebar mounting assembly in accordance with the third embodiment of the present invention.

Each roller 512, 514, 516 and 518 has a circumferential engagement face (not shown) which engages side 766 or 768 of glide 760. It is preferred to contour the engagement faces of rollers 512, 514, 516 and 518 in a manner which prevents glide 760 from abutting the roller mounting members lying above and below it. For example, the circumferential engagement faces may have grooved or channeled surfaces which receive the respective sides 766 and 768 of glide 760. The channel or groove assists in restraining the movement of glide 760 in a direction substantially perpendicular to platform 110 and minimizes the likelihood that glide 760 will abut roller mounting members 520, 522, 524 or 526. In accordance with this embodiment, glide 760 is preferably secured between roller pair 512 and 514 and between roller pair 516 and 518 in a manner which allows the handlebar 702 to be smoothly slid away from and towards platform 110 in a direction parallel to the plane defined by the platform surface, as shown in FIG. 16. As best seen in FIG. 20, glide 760 includes a retraction restraint or stop 772 at its end proximate handlebar assembly 700. Stop 772 is preferably welded to glide 760 and includes two sidewalls 773 (not visible in FIG. 20) and 775 which depend downwardly from glide 760. When handlebar 702 is retracted towards platform 110, sloped edges 773 and 775 preferably engage roller mounting member 520 to restrain the inward movement of glide 760 and handlebar 702, as best seen in FIG. 19.

Figure 18:
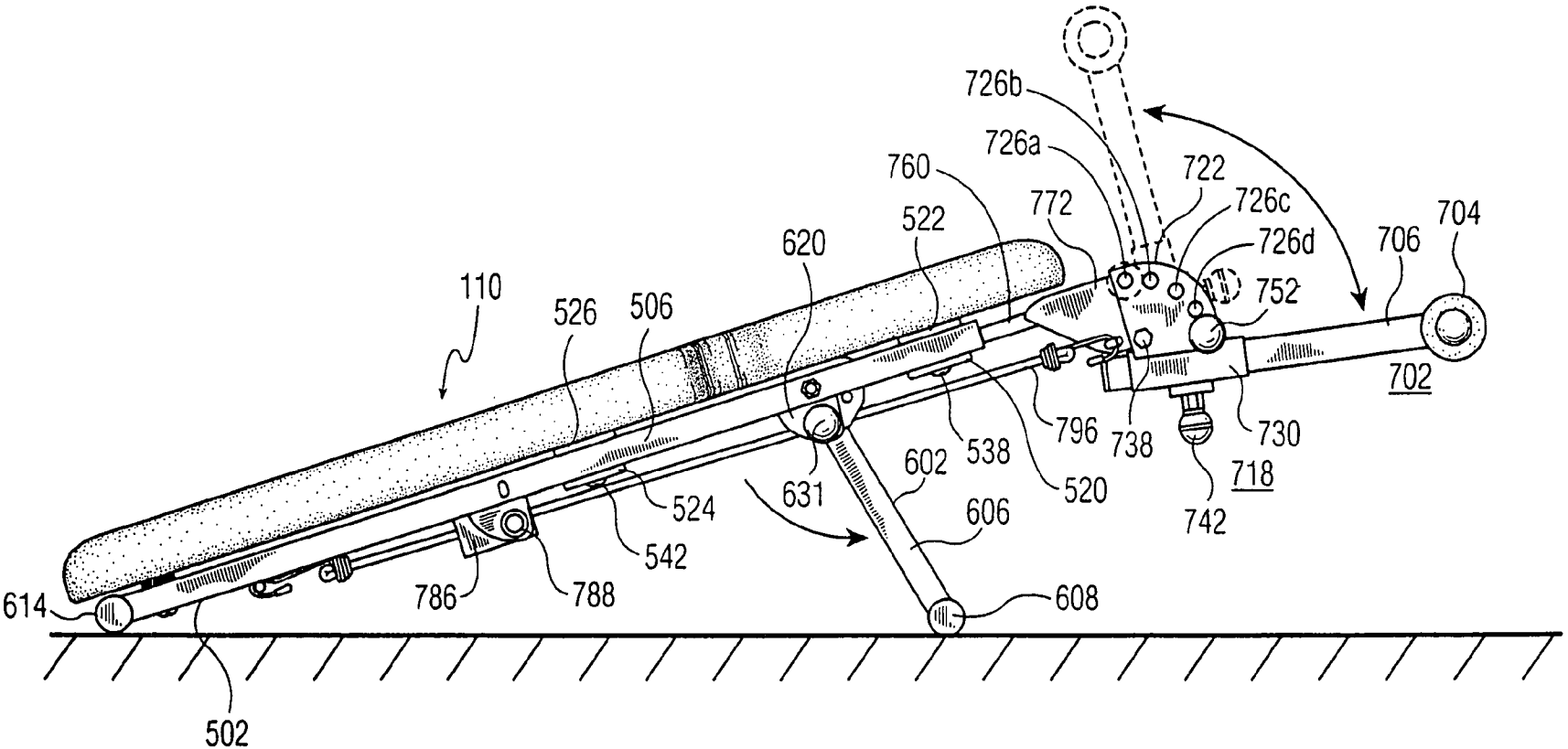
FIG. 18 is a right side elevational view thereof showing the handlebar in different rotational positions.

In accordance with the third preferred embodiment, handlebar 702 is preferably rotatable with respect to the plane defined by the surface of platform 110, as best seen in FIG. 18.

To provide this rotational capability, handlebar mounting assembly 718 is preferably connected to glide 760. More preferably, stop 772 is welded to one end of glide 760, and handlebar mounting assembly 718 is connected to stop 772.

Referring to FIG. 20, handlebar mounting assembly 718 preferably includes a pair of opposing sidewalls 720 and 722 which face one another and which are spaced apart in the direction of the width of platform 110. Sidewalls 720 and 722 may be connected to stop 772 by known attachment means. However, in the embodiment of FIG. 20, they are welded to stop 772.

Sidewall 720 includes apertures 724*a*-724*e*, and sidewall 722 includes apertures 726*a*-726*e*. Each set of apertures 724*a*-724*e* and 726*a* to 726*e* preferably defines an arc pattern along its respective sidewall, 720 or 722. Sidewalls 720 and 722 are preferably aligned and configured such that their respective apertures define aligned pairs of apertures, i.e. 724*a* and 726*a*, 724*b* and 726*b*, 724*c* and 726*c*, 724*d* and 726*d* and 724*e* and 726*e*. Handlebar mounting sleeve 730 is pivotally connected to sidewalls 720 and 722 and is sized to receive handlebar neck 706. Handlebar mounting sleeve 730 is also preferably rectangular. To provide the pivotal connection to sidewalls 720 and 722, handlebar mounting sleeve 730 includes a rotational connection sleeve 734 on its upper surface. Rotational connection sleeve 734 is preferably a tube welded to the upper surface of handlebar mounting sleeve 730. To connect the handlebar mounting sleeve 730 to sidewalls 720 and 722, rotational connection sleeve 734 is aligned with aperture 728 in side wall 722 and aperture 729 (not shown) in side wall 720. Threaded bolt 738 is inserted through apertures 728 and 729 and through rotational connection sleeve 734 to provide a pivotal connection. To secure bolt 738 to sidewalls 720 and 722, a nut 740 is preferably provided and is threadedly engaged with threaded bolt 738 at the bolt's free end. Thus, bolt 738 provides an axis about which handlebar mounting sleeve 730 may rotate with respect to the plane of platform 110.

Handlebar mounting sleeve 730 preferably includes a rotational alignment sleeve 732 which cooperates with sidewalls 720 and 722 to enable handlebar mounting sleeve and handlebar 702 to be rotated to a plurality of defined positions with respect to the plane of platform 110. Rotational alignment sleeve 732 is preferably a tube that is welded to the upper surface of handlebar mounting sleeve 730. Rotational alignment sleeve 732 is preferably positioned on handlebar mounting sleeve 730 to be alignable with aligned aperture pairs 724*a*/726*a*-724*e*/726*e*.

Handlebar 702 preferably comprises a cross-member 704 and a neck 706. As explained in detail below, neck 706 is disposed in handlebar mounting sleeve 730. The alignment of rotational alignment sleeve 732 with one of the aperture pairs 724*a*/726*a*-724*e*/726*e* defines the rotational position of handlebar 702 with respect to platform 110. Thus, by rotating handlebar mounting sleeve 730, rotational alignment sleeve 732 may be adjustably aligned with each of the different aperture pairs to vary the rotational position of the handlebar 702 between a number of pre-selected positions.

To allow the user to secure handlebar 702 at a desired rotational position, a rotational locking member 752 is provided. Rotational locking member 752 is inserted into the selected aperture pair 724*a*/726*a*-724*e*/726*e* and into rotational alignment sleeve 732 to adjustably fix the rotational position of handlebar mounting sleeve 730 and handlebar 702 with respect to the plane of platform 110. Rotational locking member 752 preferably includes a knob 758 which is attached to a first end of a shaft 754. Shaft 754 may be attached to knob 758 by any known means. However it is preferred that shaft 754 include external threads (not shown) which engage complementary internal threads in knob 758 (also not shown). At its free end, shaft 754 preferably includes a spring loaded ball bearing 756 which is biased radially outward from shaft 754. Shaft 754 preferably has a diameter that is slightly smaller than the diameters of apertures 724*a*-724*e* and 726*a*-724*e*. Ball bearing 756 preferably projects a distance from the radial center of shaft 754 which is greater than the aperture radii. To secure the rotational position of handlebar 702, rotational locking member 752 is inserted through one of the aperture pairs 724*a*/726*a*-724*e*/726*e* and through rotational alignment sleeve 732. Ball bearing 756 aids in preventing locking member 752 from slipping out of place until the user withdraws the locking member 752 with sufficient force to cause sidewall 722 (and subsequently, sidewall 720) to engage and depress ball bearing 756 radially inward of shaft 754, thereby allowing locking member 52 to be withdrawn completely from between sidewalls 720 and 722.

In the embodiment of FIG. 20, because there are 5 aperture pairs 724*a*/726*a*-724*e*/726*e*, the handlebar 702 may be rotated to five different positions with respect to platform 110. As with the previous embodiment, it is especially preferred that the aperture pairs are configured such that the handlebar is rotatable to about 10 degrees below the plane of the platform 110, about 40 degrees above the plane of the platform 110 and about 90 degrees above the plane of the platform 110.

Referring to FIG. 17, neck 706 is preferably substantially perpendicular to cross-member 704. Cross-member 704 preferably includes three pairs of hand grip segments, 712A/B, 714A/B and 716A/B, which allow the user to repeatably alter his or her hand spacings in the manner described with respect to the previous embodiment.

Referring to FIGS. 15, 17, 19 and 20, in accordance with this embodiment, the handlebar 702 may be adjusted to vary the effective length of the handlebar assembly 700. More specifically, the distance d between the handlebar cross-member 704 and the handlebar mounting sleeve 730 may be adjusted by sliding the handlebar neck 706 to a variety of positions within sleeve 730. Handlebar neck 706 includes a plurality of apertures and preferably includes five apertures 708*a*-708*f*, along its length. Handlebar mounting sleeve 730 includes an internally threaded flange 736 (see FIG. 20) which defines an aperture in sleeve 730 and projects away from its bottom surface. Flange 736 is alignable with one of the neck apertures 708*a*-708*f*. The alignment of internally threaded flange 736 with one of apertures 708*a*-708*f* determines the distance between handlebar cross-member 704 and handlebar mounting sleeve 730, and correspondingly, determines the effective length of the handlebar assembly 700 as measured from the handlebar cross-member 704 to the free end 770 of glide 760.

Locking member 742 is provided to allow the user to securely retain the handlebar 702 on the handlebar mounting sleeve 730. Referring to FIG. 20, locking member 742 includes a knob 744, hexagonal bolt 746, spring 750 and collared pin 748. Collared pin 758 is externally threaded and engages complementary internal threads (not shown) in opening 745 of knob 744. Hexagonal bolt 746 is externally threaded and has a hollow interior. Hexagonal bolt 746 also has a face 746*b* on its hexagonal head 746*a* which abuts knob 744. Face 746*b* includes an opening (not shown) through which collared pin 758 projects to allow it to threadedly engage knob 744. The opening in face 746*b* is large enough to accommodate collared pin 758, but small enough to retain spring 750 in the interior of hexagonal bolt 750. Thus, one end of spring 750 abuts collar 748*a* on pin 748, while the other end of spring 750 abuts the interior surface of hexagonal bolt face 746*b*. This configuration biases bolt 746 towards knob 744 and improves the tightness of the fit between the components of locking member 742.

The external threads on bolt 746 are preferably designed to engage the internal threads of internally threaded flange 736 on handlebar mounting sleeve 730. Hexagonal bolt 746 allows the locking member 742 to be securely retained on handlebar mounting sleeve 730 while still allowing pin 748 to be selectively withdrawn and inserted from apertures 708*a*-708*f* to facilitate the adjustment of the handlebar neck 706 within handlebar mounting sleeve 730.

To adjust the position of neck 706 within sleeve 730, the user pulls knob 744 away from sleeve 730. Because collared pin 748 is threadedly engaged with knob 744, the pin will be pulled in the direction of the knob, thereby compressing spring 750 between collar 748*a* and the interior surface of hexagonal bolt face 746*b*. Due to the threaded engagement of hexagonal bolt 746 and internally threaded flange 736, the locking member 742 will not be withdrawn from flange 736 by this operation. In order to withdraw locking member 742 from internally threaded flange 736, the user must unscrew hexagonal bolt 746 from flange 736. After pulling knob 744, the user adjusts the handlebar neck 706 to align the desired aperture 708*a*-708*f* with the internally threaded flange 736. When the alignment is complete, the user releases knob 744, causing the spring to release and force collared pin 748 and knob 744 inward. The inward movement of collared pin 748 causes its free end to be inserted through the aligned aperture 708*a*-708*f*. The insertion of collared pin 748 though the aligned aperture retains the neck at the desired position within sleeve 730 to adjustably fix the distance d (see FIG. 19) between handlebar cross-member 704 and handlebar mounting sleeve 730.

Figure 21:
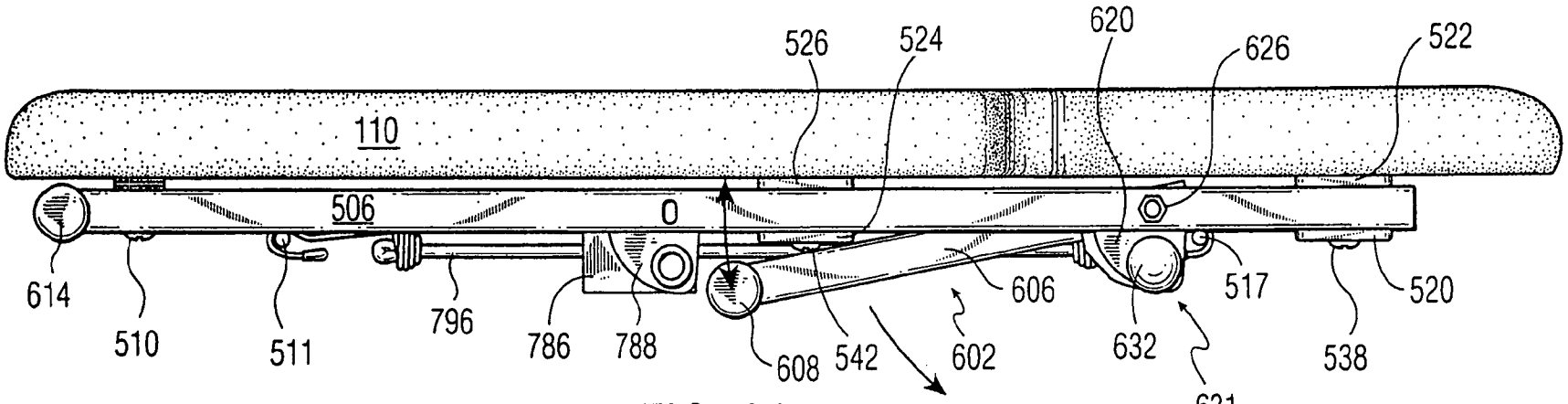
FIG. 21 is a right side elevational view of the third embodiment of the present invention with the handlebar assembly removed showing the adjustment of the device from a compact to an expanded position.
Figure 22:
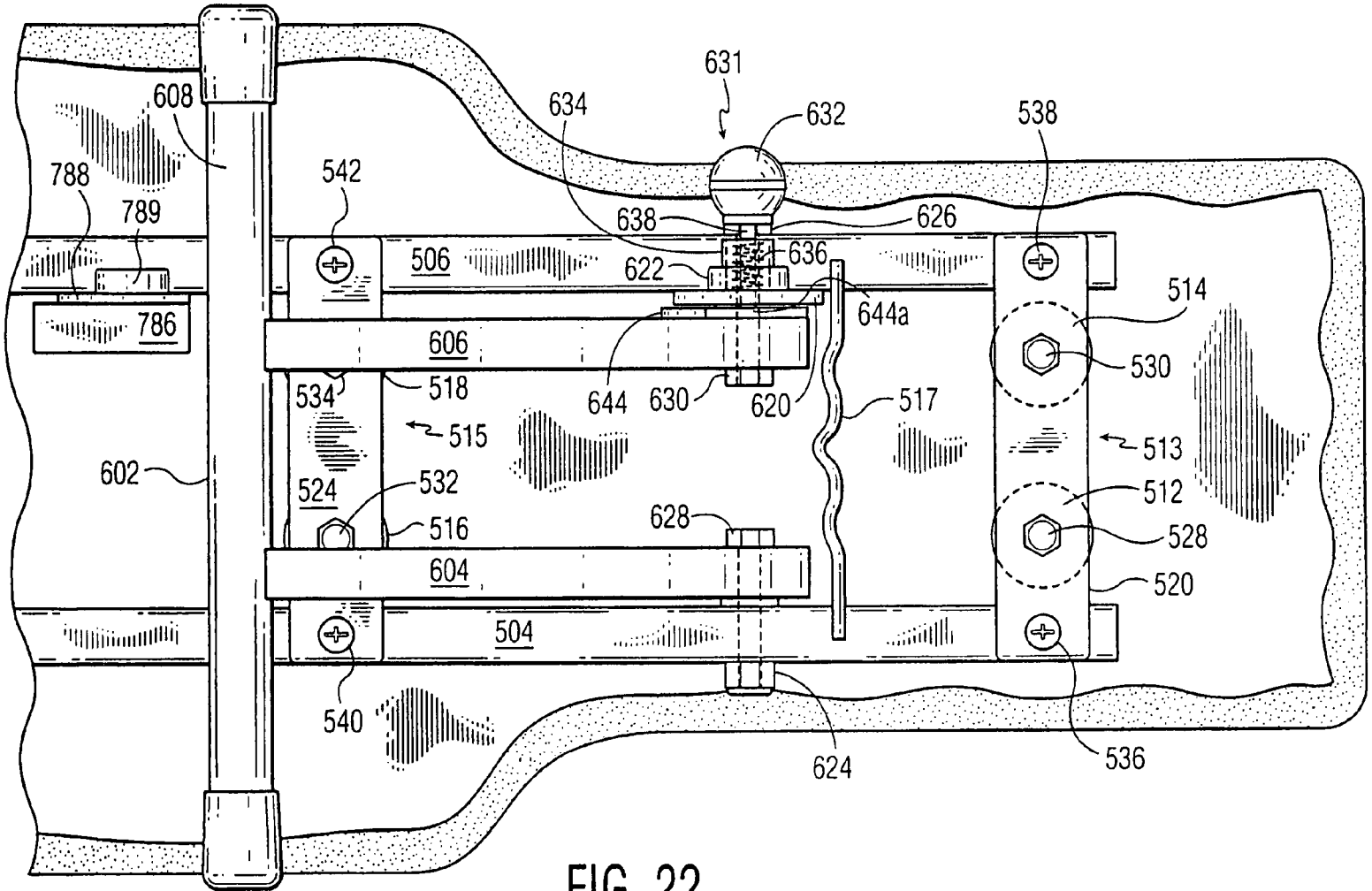
FIG. 22 is a detail bottom plan view of the third embodiment of the present invention showing the pivotal attachment of one of the base members to the platform assembly.

Referring to FIGS. 16, 21 and 22, the device of this embodiment preferably includes a base 600 for supporting the device on the ground or other surface. Base 600 preferably comprises a first base member 602 and a second base member 614 which are spaced apart along the length of platform 110. First base member 602 is connected to guide assembly 500, and is more preferably pivotally connected to frame 502 at a location that is relatively closer to handlebar 702 than the point at which second base member 614 is connected to frame 502.

First base member 602 comprises legs 604 and 606 which are pivotally connected to side members 504 and 506, respectively. Legs 604 and 606 are preferably connected by a cross-member 608 which is oriented in a direction parallel to the width of the platform 110. It is especially preferred that legs 604 and 606 are integrally connected to cross-member 608, such that the first base member comprises a unitary structure or member. It is particularly preferred that legs 602 and 604 are integrally formed with cross-member 608 or welded to it. Leg 604 is connected to side member 504 via bolt 624 and nut 628 (see FIG. 22), and leg 606 is connected to side member 506 via bolt 626 and nut 630. Bolts 624 and 626 define respective pivot axes for legs 604 and 606 and are preferably aligned to define a pivot axis about which first base member 602 rotates.

As shown in FIGS. 21 and 22, the platform assembly 100 has a compact position wherein first base member 602 is rotated in a direction that is clockwise when the device is viewed from the perspective of FIG. 21. In the compact position, cross-member 608 is preferably located proximate the underside of platform 110. As shown in FIG. 16, the device also has an expanded position, wherein first base member 602 is rotated in a direction that is counter clockwise when viewed from the perspective of FIG. 16. In the expanded position, cross-member 608 is spaced apart from platform 110.

The muscle stretching device of this embodiment preferably includes a mechanism for securing the platform assembly 100 in the expanded or compact position. In accordance with this embodiment, a locking member 631 (FIG. 22) is provided. Like locking member 742, locking member 631 preferably includes a knob 632, a hexagonal bolt 634, a spring 636 and a collared pin 638. The components of locking member 631 of this preferred embodiment cooperate in the same manner as the corresponding components of locking member 742, described previously.

A bracket 620 is connected to side member 506 of frame 502, preferably by welding it to frame 502, and includes an internally threaded flange 622. Flange 622 defines an aperture through bracket 620 and projects away from first base member 602. Leg 606 preferably includes a welded reinforcement 644 with an aperture 644*a* that is aligned with internally threaded flange 622 and which is dimensioned to receive the free end of collared pin 638. Welded reinforcement 644 provides extra thickness for securing the connection between locking member 631 and first base member 602. However, a welded reinforcement is optional and aperture 644*a* could be provided in leg 606 without the use of a welded reinforcement.

When the muscle stretching device of this embodiment is in the expanded position, aperture 644*a* is preferably aligned with internally threaded flange 622. Hexagonal bolt 634 threadedly engages internally threaded flange 622 to secure locking member 631 to bracket 620. To rotate first base member 602 and adjust platform assembly 100 between its compact and expanded positions, the user pulls knob 632 away from first base member 602. Because collared pin 638 threadedly engages knob 632, the pin will move away from first base member 602, and its collar 640 (not shown) will compress spring 636 against the interior surface of the face of the bolt head of hexagonal bolt 634 in the same manner described previously with respect to spring 750 and hexagonal bolt 746 of locking member 742. The user then rotates first base member 602 about the axis defined by bolts 624 and 626 to the desired position. Once the rotation is complete, the user releases knob 632, causing spring 636 to release. The releasing action of spring 636 then biases collared pin 638 towards first base member 602 such that the free end of collared pin 638 projects through aperture 644*a* of welded reinforcement 644, thereby preventing further rotation of first base member 602 with respect to platform 110. In the expanded position, first base member 602 and platform 110 define an angle θ that ranges generally from about 5 degrees to about 15 degrees, preferably from about 8 degrees to about 12 degrees and which is more preferably about 10 degrees.

As mentioned previously, base 600 also preferably comprises a second base member 614 spaced apart from first base member 602. In a preferred embodiment, second base member 602 is welded to side members 504 and 506 or is integrally formed with them. Second base member 614 is preferably a cross-member positioned along the width of the platform 110 and is also preferably substantially parallel to cross-member 608 of first base member 602. As shown in FIG. 15, second base member 614 may include a downwardly projecting stop 615 which aids in restraining the retraction of glide 760 by abuttingly engaging free end 770 of glide 760.

The muscle stretching device of this preferred embodiment allows the user to attach one or more resistance increasing devices such as a stretchable band, elongated spring, or more preferably, a bungee cord. Referring to FIG. 15, three bungee cords are shown. To facilitate the attachment of the bungee cords, rod 511 is connected to side members 504 and 506 proximate second base member 614. Stop 772 includes a rod 778 having a center portion 780 disposed between stop sidewalls 773 and 775 and side projections 782 and 784 projecting away from stop 772. Rod 778 is preferably a single rod that is welded to stop 772 or connected by other known connecting means. As shown in FIG. 15, bungee cord 794 is connected at one end to center portion 780, while bungee cords 792 and 796 are connected at one end to side projections 782 and 784, respectively. The other ends of bungee cords 792, 794 and 796 are connected to rod 511. Thus, as the user slides handlebar 702 away from platform 110, the bungee cords 792, 794 and 796 will stretch, thereby providing increased resistance.

To facilitate the storage of bungee cords or other resistance increasing devices when they are not in use, rod 517 is provided as shown in FIG. 15. Rod 517 is connected at its ends to side members 504 and 506 and is stationary. Thus, when the bungee cords are not in use, they may be attached to rod 517 instead of to rod 778, as shown in FIG. 21, providing a convenient means of storing the cords until increased resistance is desired.

The device of this embodiment is preferably used to perform the preferred embodiments of methods for stretching muscles described previously. However, in accordance with another preferred embodiment of a method for stretching muscles, prior to using the device, the user adjusts the handlebar 702 in the manner previously described to obtain the desired distance between the handlebar cross-member 704 and the handlebar mounting sleeve 730. The adjustment of this distance determines the starting distance of the user's hands from his shoulders and allows the user to adjust the range of stretching.

The embodiments described above are exemplary embodiments of the present invention. Those skilled in the art may now make numerous uses of, and departures from, the above-described embodiments without departing from the inventive concepts disclosed herein. Accordingly, the present invention is to be defined solely by the scope of the following claims.

What is claimed is:

1. A muscle stretching device, comprising: a. a platform mounted to a base, the platform having a surface defining a plane; b. a handlebar having a neck, a cross bar, and a plurality of rotational positions with respect to the plane of the platform; and c. a handlebar mounting assembly operatively connected to the platform and adapted for sliding movement away from the platform in a direction parallel to the plane, the handlebar mounting assembly comprising a pair of sidewalls and a handlebar mounting sleeve connected to the pair of sidewalls, the handlebar mounting sleeve being rotatable between the pair of sidewalls, wherein the handlebar neck is disposed in the handlebar mounting sleeve.

2. The muscle stretching device of claim 1, wherein each sidewall in the pair of handlebar mounting assembly sidewalls has a plurality of apertures, the plurality of apertures in one of the pair of sidewalls is aligned with the plurality of apertures in the other of the pair of sidewalls to define a plurality of aligned pairs of apertures, and each aligned pair of apertures defines one of the plurality of handlebar rotational positions.

3. The muscle stretching device of claim 1, wherein one of the plurality of rotational positions is about 90 degrees above the plane.

4. The muscle stretching device of claim 1, wherein one of the plurality of rotational positions is about 40 degrees above the plane.

5. The muscle stretching device of claim 1, wherein one of the plurality of rotational positions is about 10 degrees below the plane.

6. The muscle stretching device of claim 2, wherein the plurality of apertures in each sidewall defines an arcuate pattern in the corresponding handlebar mounting assembly sidewall.

7. The muscle stretching device of claim 1, wherein the handlebar mounting sleeve is rotatable with respect to the plane.

8. The muscle stretching device of claim 1, wherein the handlebar mounting assembly further comprises a rotational alignment sleeve connected to the handlebar mounting sleeve, and the rotational alignment sleeve is alignable with each of the plurality of aligned pairs of apertures.

9. The muscle stretching device of claim 8, wherein the handlebar mounting assembly further comprises a rotational locking member disposed in the rotational alignment sleeve and one of the plurality of aligned pairs of apertures.

10. The muscle stretching device of claim 1, wherein the handlebar assembly further comprises a rotational connector sleeve attached to the handlebar mounting sleeve.

11. The muscle stretching device of claim 10, wherein each said sidewall has a rotational connector aperture and the handlebar assembly further comprises a connector disposed in the rotational connector apertures of each said sidewall and the rotational connector sleeve.

12. The muscle stretching device of claim 1, wherein the handlebar mounting assembly is connected to a sliding engagement member.

13. The muscle stretching device of claim 12, further comprising a guide assembly connected to the platform, wherein the sliding engagement member slidingly engages the guide assembly.

14. The muscle stretching device of claim 1, wherein the handlebar cross-bar is adjustable to a plurality of distances from the handlebar mounting sleeve.

15. The muscle stretching device of claim 14, wherein the handlebar neck comprises a plurality of apertures.

16. The muscle stretching device of claim 15, wherein the handlebar mounting sleeve has an aperture that is aligned with one of the apertures in the plurality of apertures on the handlebar neck, and the alignment of the handlebar mounting sleeve aperture and said one of the plurality of handlebar neck apertures defines one of the plurality of distances from the handlebar mounting sleeve to the handlebar cross-bar.

17. The muscle stretching device of claim 16, further comprising a locking member removably disposed in said one of the handlebar neck apertures aligned with the handlebar mounting sleeve aperture.

18. The muscle stretching device of claim 1, wherein the handlebar is rotatable with respect to the plane.

19. The muscle stretching device of claim 1, wherein the handlebar mounting assembly has a first position proximate the platform and a second position distal from the platform.

20. A muscle stretching device, comprising:

a. a platform assembly, including a platform and a base comprising a unitary first base member having two legs integrally connected by a first cross-member, wherein the first base member is pivotally connected to the platform assembly such that the platform assembly is adjustable between a compact position and an expanded position;

b. a handlebar, operatively connected to the platform assembly, wherein the platform has a surface defining a plane, and wherein the handlebar is adapted for sliding movement with respect to the platform and in a direction that is generally parallel to the plane of the platform.

21. The muscle stretching device of claim 20, wherein the platform has a surface defining a plane and the handlebar is rotatable with respect to the plane.

22. The muscle stretching device of claim 20, wherein the platform has a surface defining a plane and the first base member is rotatable with respect to the plane.

23. The muscle stretching device of claim 20, wherein when the platform assembly is in the expanded position, the first cross-member is spaced apart from the platform.

24. The muscle stretching device of claim 20, wherein the base further comprises a second base member connected to the platform assembly, the platform has a length defining a lengthwise direction, and the first base member is spaced apart from the second base member in the lengthwise direction.

25. The muscle stretching device of claim 20, wherein the platform has a first end proximate the handlebar and a second end distal from the handlebar, and the first base member is connected to the platform assembly proximate the first end of the platform.

26. The muscle stretching device of claim 25, wherein the second base member is connected to the platform assembly proximate the second end of the platform.

27. The muscle stretching device of claim 20, wherein in the expanded position, the platform and the pair of legs define an angle ranging from about 5 to about 15 degrees.

28. The muscle stretching device of claim 20, wherein in the expanded position, the platform and the pair of legs define an angle ranging from about 8 to about 12 degrees.

29. The muscle stretching device of claim 20 wherein in the expanded position, the platform and the pair of legs define an angle of about 10 degrees.

30. The muscle stretching device of claim 20, wherein the platform assembly further comprises a guide assembly having a frame, and the first base member is pivotally connected to the frame.

* * * * *